US011205325B2

(12) United States Patent
Nelson et al.

(10) Patent No.: US 11,205,325 B2
(45) Date of Patent: Dec. 21, 2021

(54) CRAPS GAMING SYSTEM AND METHOD

(71) Applicant: IGT, Las Vegas, NV (US)

(72) Inventors: Dwayne Nelson, Las Vegas, NV (US); Alfred Smith, Las Vegas, NV (US); Derrick Price, Las Vegas, NV (US)

(73) Assignee: IGT, Las Vegas, NV (US)

( * ) Notice: Subject to any disclaimer, the term of this patent is extended or adjusted under 35 U.S.C. 154(b) by 42 days.

(21) Appl. No.: 16/591,110

(22) Filed: Oct. 2, 2019

(65) Prior Publication Data

US 2020/0035067 A1 Jan. 30, 2020

Related U.S. Application Data

(63) Continuation of application No. 15/848,266, filed on Dec. 20, 2017, now Pat. No. 10,438,450.

(51) Int. Cl.
*G07F 17/32* (2006.01)

(52) U.S. Cl.
CPC ..... *G07F 17/3286* (2013.01); *G07F 17/322* (2013.01); *G07F 17/3206* (2013.01); *G07F 17/3244* (2013.01)

(58) Field of Classification Search
None
See application file for complete search history.

(56) References Cited

U.S. PATENT DOCUMENTS 4,467,424 A 8/1984 Hedges et al.
D364,650 S 11/1995 Hanscom
5,490,670 A 2/1996 Hobert
5,934,676 A 8/1999 Rubin
6,609,710 B1 8/2003 Order
D561,270 S 2/2008 O'Connor et al.
7,465,230 B2 12/2008 Lemay et al.
7,669,854 B1 3/2010 Thompson et al.
7,914,368 B2 3/2011 Chun
7,918,723 B2 4/2011 Chun
7,922,587 B2 4/2011 Chun
8,157,631 B2 4/2012 Lancaster et al.
8,162,732 B1 4/2012 Juds et al.
8,182,321 B2 5/2012 Chun
8,210,920 B2 7/2012 Chun
8,308,559 B2 11/2012 Chun
8,376,362 B2 2/2013 Nicely et al.
8,545,300 B2 10/2013 Colton
8,614,668 B2 12/2013 Pryor
8,668,564 B2 3/2014 Chun
8,684,830 B1 4/2014 Chun
8,821,239 B1 9/2014 Chun
8,920,238 B2 12/2014 Chun
D734,398 S 7/2015 Pham
9,189,918 B1 11/2015 Gronkowski et al.
(Continued)

FOREIGN PATENT DOCUMENTS

WO 2006124912 A2 11/2006
WO 2008112428 A1 9/2008
WO 2017140385 A1 8/2017

*Primary Examiner* — Damon J Pierce
(74) *Attorney, Agent, or Firm* — Neal, Gerber & Eisenberg LLP

(57) ABSTRACT

In various embodiments, the present disclosure relates generally to gaming systems and methods providing a live craps game and a plurality of electronic gaming machines that facilitate participation in the live craps game.

20 Claims, 11 Drawing Sheets

(56) References Cited

U.S. PATENT DOCUMENTS

| | | | | |
|---|---|---|---|---|
| 9,390,592 | B2 | 7/2016 | Chun | |
| 9,418,519 | B2 | 8/2016 | Walker | |
| 9,592,450 | B2 | 3/2017 | Chun | |
| 9,595,159 | B2 | 3/2017 | Chun | |
| 9,595,166 | B2 | 3/2017 | Chun | |
| 9,616,326 | B2 | 4/2017 | Murdock | |
| 9,666,024 | B2 | 5/2017 | Chun | |
| RE46,738 | E | 2/2018 | Sasaki et al. | |
| 2006/0217174 | A1 | 9/2006 | Walker et al. | |
| 2007/0060237 | A1 | 3/2007 | Rowe et al. | |
| 2008/0054565 | A1 | 3/2008 | O'Connor et al. | |
| 2008/0113767 | A1 | 5/2008 | Nguyen et al. | |
| 2008/0230993 | A1 | 9/2008 | Chun | |
| 2009/0098932 | A1* | 4/2009 | Longway | G07F 17/322 463/22 |
| 2009/0247254 | A1 | 10/2009 | Schlottmann et al. | |
| 2012/0004037 | A1 | 1/2012 | Hill | |
| 2012/0061913 | A1* | 3/2012 | Nicely | A63F 9/0406 273/145 CA |
| 2013/0190075 | A1 | 7/2013 | Chun | |
| 2014/0274252 | A1 | 9/2014 | Chun | |
| 2016/0012674 | A1 | 1/2016 | Chun | |
| 2016/0335837 | A1 | 11/2016 | Shigeta | |
| 2016/0351008 | A1 | 12/2016 | Walker | |
| 2017/0024975 | A1 | 1/2017 | Chun | |
| 2017/0256129 | A1 | 9/2017 | Chun | |
| 2018/0315276 | A1 | 11/2018 | Persson et al. | |
| 2019/0108713 | A1* | 4/2019 | Fink | G07F 17/3204 |

* cited by examiner

1000

CRAPS GAMING SYSTEM AND METHOD

PRIORITY

This patent application is a continuation of, claims priority to and the benefit of U.S. patent application Ser. No. 15/848,266, filed on Dec. 20, 2017, the entire contents of which are incorporated by reference herein.

BACKGROUND

Craps is a well known game. Craps is typically played in casinos at physical craps tables. Each physical craps table is typically oval or oblong and configured to be simultaneously played by 10 to 12 live players. The live players typically stand around three sides of the physical craps table. The typical physical craps table is operated by three live dealers who are positioned on the fourth side of the physical craps table. Even though physical craps tables are relatively large, the size of the physical craps table limits the quantity of players who can play the craps game at or associated with a physical craps table. The size of the physical craps table also limits the amounts that can be wagered on plays of the craps game at or associated with the physical craps table.

SUMMARY

In various embodiments, the present disclosure provides a craps gaming system and method that expands the quantity of players that can a play craps game associated with a physical craps table. In various embodiments, the present disclosure provides a craps gaming system and method that also increases the amounts that can be wagered on plays of a craps game at a physical craps table. The craps gaming system of the present disclosure provides numerous additional advantages that are discussed in more detail below.

In various example embodiments, the present disclosure relates to a craps gaming system including a physical craps table monitoring system comprising a video camera configured to capture live video of movements of a pair of dice on a playing surface of a physical craps table, and a craps game state data processing system configured to: receive a video feed from the physical craps table monitoring system and analyze selected frames of the video feed to determine one or more of: when the pair of dice are at a holding position on the playing surface of the physical craps table, when the pair of dice are at being moved on the playing surface of the physical craps table toward a player at the physical craps table, when the pair of dice have been picked up by the player at the physical craps table, when the pair of dice have been rolled by the player at the physical craps table, if the roll of the pair of dice is a valid roll, and the numbers shown on the pair of dice. The craps game state data processing system is further configured to create certain various game state data corresponding to: the pair of dice being at the holding position on the playing surface of the physical craps table, the pair of dice being moved on the playing surface of the physical craps table toward the player at the physical craps table or the pair of dice having been picked up by the player at the physical craps table, the pair of dice having been rolled by the player at the physical craps table, the roll of the pair of dice being a valid roll, and the numbers on the pair of dice. The craps game state data processing system is further configured to send the various game state data to a plurality of electronic gaming machines to enable each of the electronic gaming machines to: enable player wagering at the electronic gaming machine responsive to the received game state data indicating that the pair of dice are at the holding position on the playing surface of the physical craps table, disable player wagering at the electronic gaming machine responsive to the game state data indicating that the pair of dice have been picked up by the player at the physical craps table, and determine any payouts to the player based on wagers made by the player and responsive to the game state data indicating that the roll of the pair of dice is valid roll, and the numbers on the pair of dice.

Additional features and advantages are described in, and will be apparent from, the following Detailed Description and the figures.

DETAILED DESCRIPTION

Craps Gaming System

Figure 1:
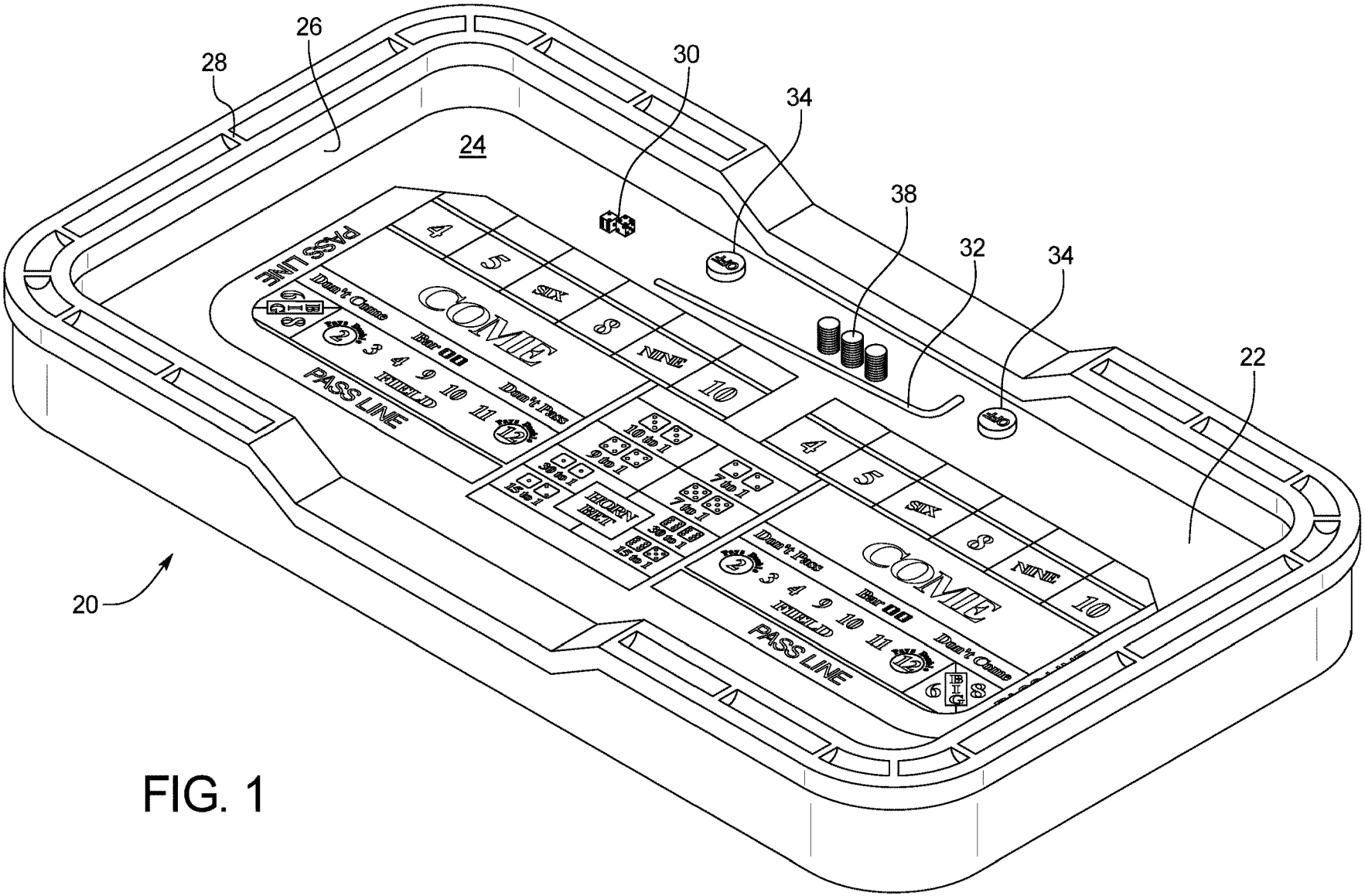
FIG. 1 is a perspective view of an example physical craps table that can be employed as part of or with craps gaming systems of the present disclosure.

In various embodiments, the present disclosure relates generally to craps gaming systems and methods for providing a live craps game at a physical craps table and simultaneously at multiple remote electronic betting terminals or electronic gaming machines (referred to herein for brevity as an "EGM" or as "EGMs"). The EGMs facilitate remote player participation in the live craps game at the physical craps table.

Referring now to the drawings, and particularly FIGS. 1, 2A, 2B, 2C, 3A, 3B, 4, 5, 6, 7A, 7B, and 7C, in various example embodiments of the present disclosure, the craps gaming system 10 generally includes: (a) a physical craps table 20; (b) various craps game components 30, 32, 34, 36, and 38 needed to provide plays of a craps game at the physical craps table 20; (c) a physical craps table monitoring system 50; (d) one or more craps game state data processing systems 60; (e) a dealer station 70 positioned adjacent to the physical craps table 20; and (f) a plurality of EGMs such as EGMs 80*a*, 80*b*, 80*c*, 80*d*, 80*n*, 2000*a*, 2000*b*, and 2000*c*.

In various other example embodiments of the present disclosure, the craps gaming system includes: (a) a physical craps table monitoring system 60; (b) one or more craps game state data processing systems 50; and (c) a dealer station 70, that are configured to operate with: (i) an existing physical craps table; (ii) existing various craps game components needed to provide plays of a craps game at the physical craps table; and (iii) a plurality of modified EGMs.

Figure 2A:
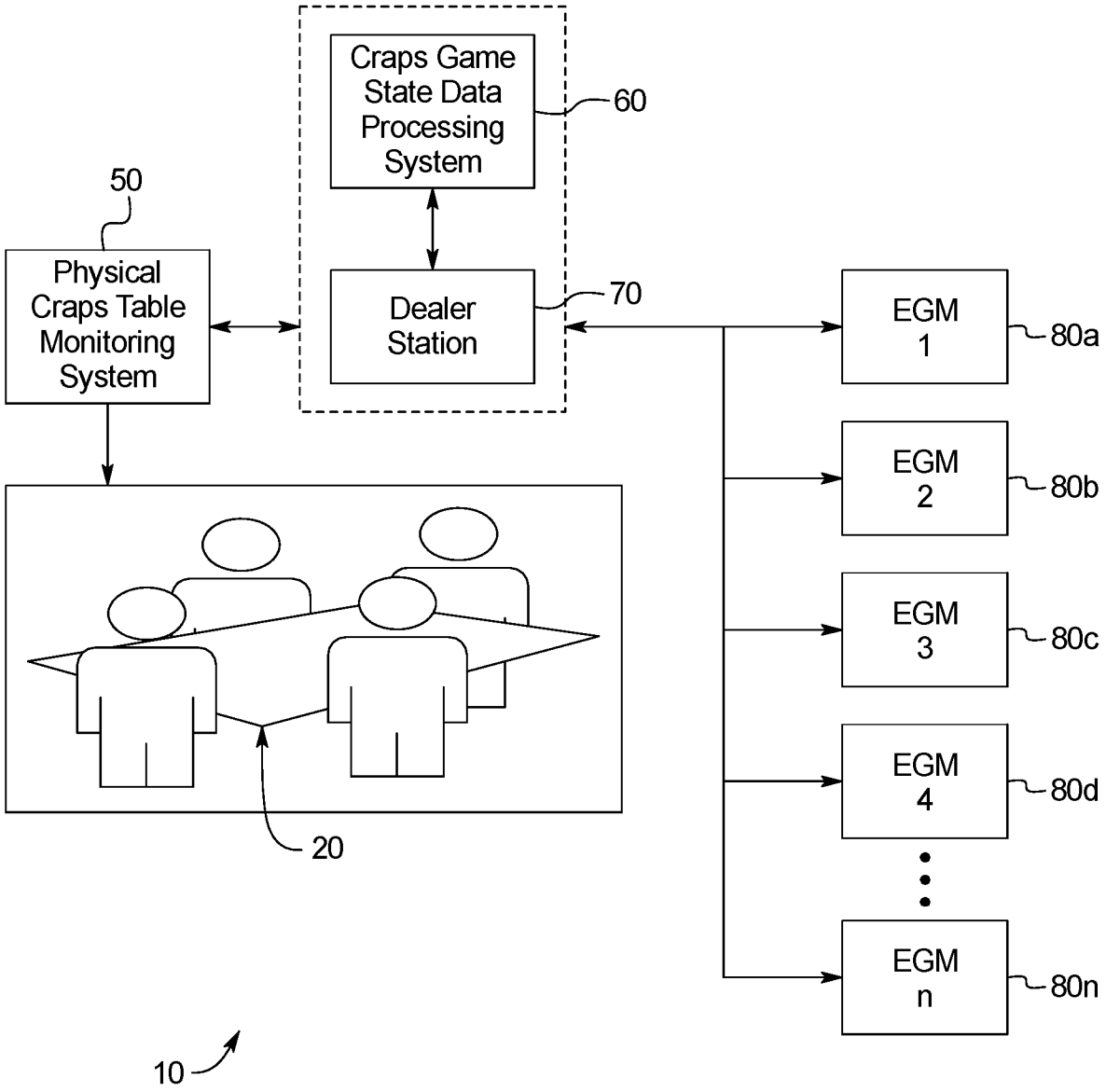
FIG. 2A is a schematic block diagram of one example embodiment of an electronic configuration of the craps gaming systems of the present disclosure.

In various example embodiments of the present disclosure, as shown in FIG. 2A, the craps game state data processing system and the dealer station are combined for operation with a physical craps table.

Figure 2B:
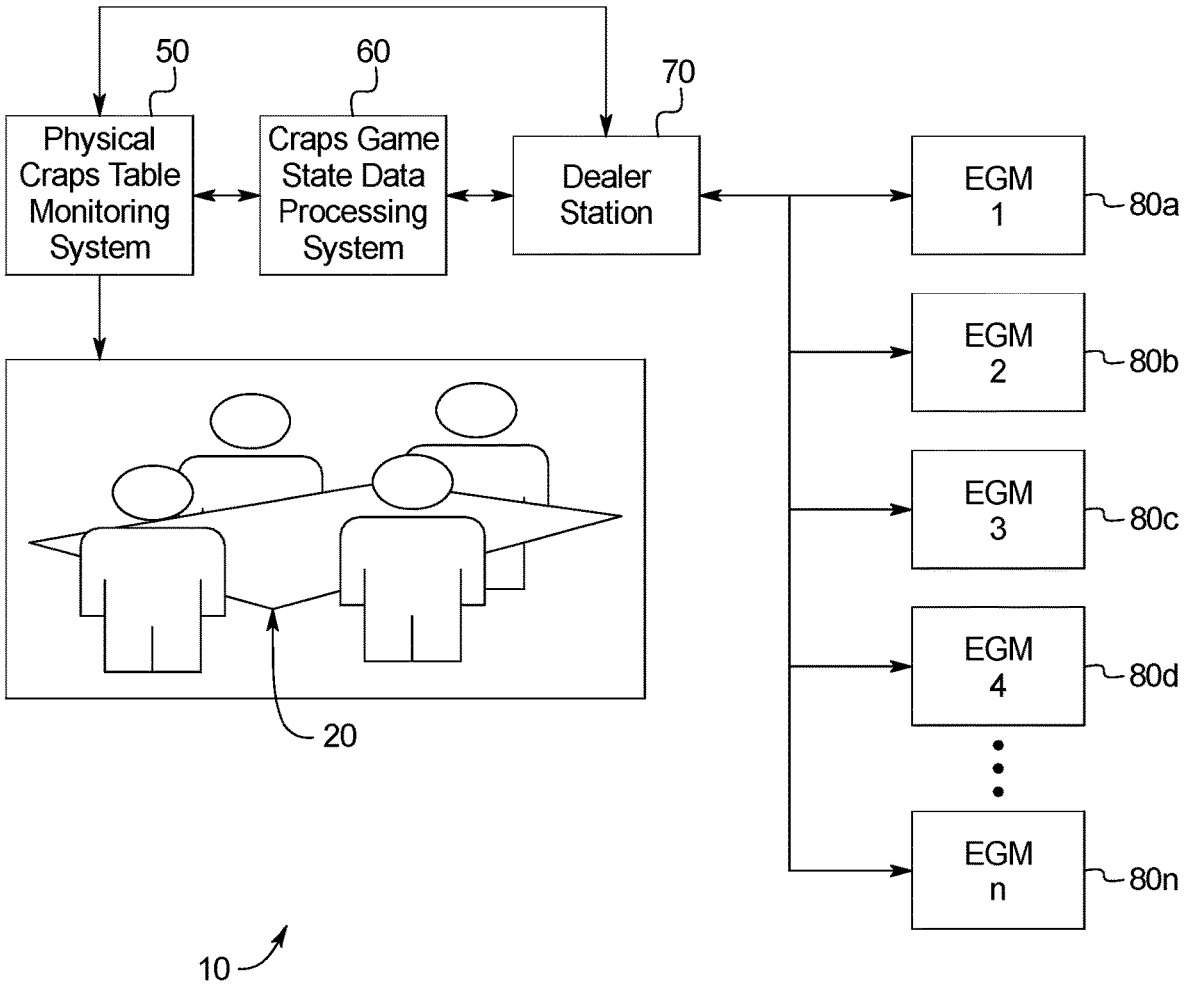
FIG. 2B is a schematic block diagram of another example embodiment of an electronic configuration of the craps gaming systems of the present disclosure.

In various example embodiments of the present disclosure, as shown in FIG. 2B, the more craps game state data processing system and the dealer station are separate components in communication with each other and arranged to communicate with the various other components of the craps gaming system.

Figure 2C:
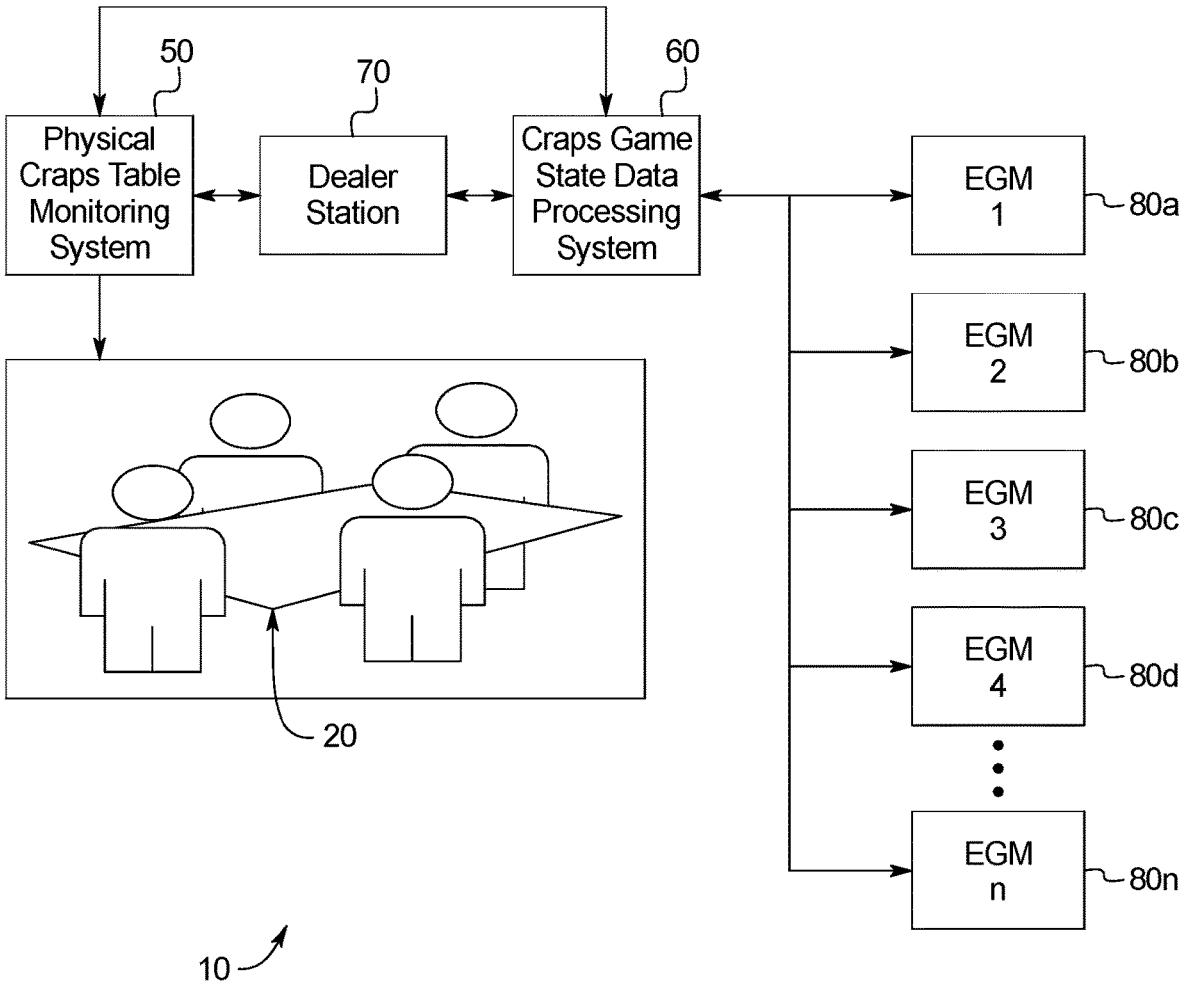
FIG. 2C is a schematic block diagram of another example embodiment of an electronic configuration of the craps gaming systems of the present disclosure.

In various other example embodiments of the present disclosure, as shown in FIG. 2C, the craps game state data processing system and the dealer station are separate components in communication with each other and alternatively arranged to communicate with the various other components of the craps gaming system.

Various components of various example craps gaming system and method of the present disclosure are further discussed in more detail below.

Example Physical Craps Table

More specifically, in the example embodiments of FIGS. 1 to 7C, the example physical craps table 20 that the craps gaming system 10 includes or that the craps gaming system 10 is employed to operate with is generally shown. This example is a conventional physical craps table 20 that includes: (a) a flat elongated somewhat oval or oblong table top 22; (b) a plurality of legs (not shown) that support the table top 22; (c) a felt material positioned over the table top 22 that provide a playing surface 24 for the craps game; (d) a plurality of betting spaces or areas indicated by or on the playing surface 24 of the felt material; (e) an upright peripheral wall 26 surrounding at least part of the table top 22; and (f) a peripheral rail 28 attached to and extending around most of the upright peripheral wall 26. The table top 22 and the upright peripheral wall 26 generally define a betting area and a dice rolling area or pit. It should be appreciated that the present disclosure can be implemented with other suitable physical craps tables.

Various Craps Game Components

In the example embodiments of FIGS. 1 to 7C, the example physical craps game components that the gaming system 10 includes or that the gaming system 10 is employed to operate with are generally shown. These various craps game components are conventional craps game components used to provide plays of a craps game at the physical craps table 20 and include: (a) one or more pairs of physical dice 30 (including two individual 6 sided die—each with the conventional dot numbers such as one dot (•) representing the number 1); (b) a physical dice moving stick 32; (c) one or more physical point or ON/OFF buttons or discs 34; and (d) physical player wagering chips 38. It should be appreciated that the present disclosure can be implemented with other suitable combinations of craps game components.

Example Craps Game Physical Operations for Craps Game Play

In the example embodiments of FIGS. 1 to 7C, the physical craps table 20 and the various craps game components 30, 32, 34, 36, and 38 enable or facilitate multiple plays of a craps game at the physical craps table 20. During these multiple plays of the craps game, live players make wagers or bets (primarily referred to herein for brevity as a "wager" or "wagers") against the casino or the house (primarily referred to herein for brevity as the "casino"), and in which the casino covers all player wagers at the physical craps table 20 (i.e., pays each of the players on any of their winning wagers according to a predetermined paytable). The physical craps table 20 and the various craps game components 30, 32, 34, 36, and 38 of the present disclosure are configured to enable plays of a conventional craps game as generally explained below, or any other suitable craps game.

In a conventional play of a craps game at a physical craps table 20, each live player at the physical craps table has their own chips that enable that player to make one or more wagers by placing the player's chips on one or more of the indicated different betting spaces or areas on the playing surface 24 of the physical craps table 20. In a conventional play of a craps game at a physical craps table, the dealers that run the craps game for the casino also have chips that enable the dealers to pay out on winning wagers made by the players at the physical craps table 20.

In a conventional play of a craps game at a physical craps table 20, at the start of a play of a craps game, the players make initial wagers and one of the dealers assigns the pair of physical dice 30 to one of the players at the physical craps table 20. This player is usually called or designated as the "shooter." Conventional casino rules typically require that the shooter be selected from the players who have made at least a minimum wager on the play of craps game (such as a wager on either the "Pass" line or the "Don't Pass" line).

After the shooter is selected and after most, if not all of, the initial wagers are placed, the dealer provides the physical dice to the shooter typically using an elongated craps stick such as stick 32. Specifically, the dealer moves or slides the pair of dice 30 on the playing surface 24 of the physical craps table 20 from a dice holding position to a position on the physical craps table in front of the shooter. The player then picks up the pair of dice and the rolls or throws (primarily referred to herein for brevity as "rolls") the pair of dice in the pit defined by the physical craps table and on the playing surface. The shooter typically throws the pair of dice against one of the end upright walls at one end of the oval or oblong physical craps table.

It should be appreciated that many shooters will often arrange or rearrange the dice on the playing surface of the physical craps table one or more times before the shooter picks up the dice in one of the shooter's hands. For example, a shooter may arrange the dice such that the one dots are on the top side of each of the dice before the player's picks up the dice.

It should be appreciated that many shooters will often shake the pair of dice in one of the shooter's hands for one or more seconds before rolling the pair of dice onto the physical craps table.

It should be appreciated that certain players at the physical craps table may place or try to place additional wagers on physical craps table even after the shooter has been provided the pair of dice or even after the shooter has picked up the pair of dice. The dealer(s) at the physical craps table will determine whether or not to allow such bets to be placed by such players. Usually, such late bets are not allowed if made after the shooter starts to roll or rolls the dice.

After the shooter rolls the dice and each of the dice come to rest on the playing surface 24, at least one of the dealers determines whether the roll is an invalid roll (sometimes called a "no throw") or a valid roll. In other words, based on a set of casino rules, the dealer determines whether or not the dice have been rolled properly and whether or not the dice have landed properly. Such invalid rolls are usually not used to determine the outcome of any player wagers, and in such situations, the shooter is normally permitted or asked to re-roll the pair of dice (with only a subsequent valid roll being used to determine wager outcomes). For example, if one or more of the dice lands on an edge or corner where it is not clear which face or number on that die is actually face up or shown, the dealer will declare the roll to be invalid and provide the dice back to the shooter to re-roll. In another example, if one or more of the dice lands off of the physical craps table, the dealer will declare the roll to be invalid and provide the dice back to the shooter to re-roll.

Once the shooter makes a valid roll such that each of the dice is clearly positioned on the playing surface 24 in a manner where one side of that die is face up and can be clearly determined or read, the dealer will declare the roll to be valid (typically by orally reading, stating, or calling out the combination of numbers shown on the pair of dice or that have been rolled on or indicated by the rolled pair of dice). In other words, these are the numbers shown on the respective surfaces of the dice that are upwardly facing or face up.

The dealers then evaluate the wagers made by the players using the chips on the physical craps table, and pay, collect, leave in play, or otherwise act on each wager based on that outcome of the roll of the dice and the rules associated with plays of the craps game set by the casino for that physical craps table.

In a conventional play of a craps game at a physical craps table in a casino, the process of enabling the players to make wagers and assigning the dice to one of the players at the physical craps table is repeated for the next roll of the dice.

Whether the next roll of the dice is part of the same play of the craps game and whether the next roll of the dice is made by the same shooter typically depends on the outcome of the previous roll of the dice and the casino rules for the play of the craps game. It should thus be appreciated that a play of a crap game can include one or more rolls of the dice by a shooter, and often includes multiple rolls by a shooter.

Example Craps Game Play

In a conventional play of a craps game at a physical craps table, the first round or roll of the dice of the play of the craps game is part of the "come-out" phase. In the come-out phase, no "point" has yet been selected for that play of the craps game. During the come-out phase, it is common for a disc called the "On" button 34 to be placed, inverted, on the playing surface of the physical craps table to display the reverse-side text (usually "Off").

In a conventional craps game at a physical craps table, during the come-out phase: (a) a roll of 2, 3, or 12 results in a loss for bettors on the "Pass" line; (b) a roll of 2 or 3 results in a win for bettors on the "Don't Pass" line; (c) a roll of 12 results in a tie or "push" for bettors on the "Don't Pass" line; (d) a roll of a "natural" 7 or an 11 results in a win for bettors on the "Pass" line; (e) a roll of a "natural" 7 or an 11 results in a loss for bettors on the "Don't Pass" line; and (f) a roll of a 4, 5, 6, 8, 9, or 10 results in a point being set for future rolls of the dice in a "point" phase of the play of the craps game. The come-out phase may thus include multiple rolls of the dice before a point is set.

Once a number corresponding to a valid point is rolled, the come-out phase ends, and the play of the game enters the point phase. When a point is established, the OFF button is usually inverted to display the text "ON" and placed on a portion of the playing surface designated for the point number that was rolled. The point phase of the play of the craps game continues until the shooter rolls the point number again, a "seven" (which is sometimes called a "seven-out"), or a forfeit of the play of the game occurs. In other words, the point phase continues through subsequent rolls of the dice until the shooter either wins by rolling the same number as was thrown to set the point (i.e., the number currently indicated by the "ON" button), or the player loses by rolling a seven. After each roll of the dice during the point phase of the play of the craps game (and before the subsequent roll of the dice), any payouts for winning wagers are made and the players can make additional wagers If the shooter wins by rolling the point, any appropriate bets are pad out, and the play of the craps game reverts back to the come-out phase, and the On button is flipped to "Off."

If the shooter loses by rolling the seven, the play of the craps game ends, and a new shooter is typically selected.

It should be appreciated that the above is only a high level description of a play of a typical craps game, and that a play of a typical craps game includes many more rules that can be taken into account by the craps gaming system and method of the present disclosure.

Example Craps Game Video Feed and Game State Data

It should be appreciated from the above description that the physical actions including the dice movements (including the rolls of the dice) at a physical craps table and the craps game play and related outcomes are intertwined and relatively complicated. These actions and game play need to be tracked very carefully to determine exactly each stage of the play of the craps game, the respective allowed actions (such as when player wagering and player movement of the dice are allowed and not allowed), and all of the appropriate payouts. It should also be appreciated from the above that a craps game at a physical craps table can be fairly hectic for the dealers of the craps table to fully manage (which is why there are typically three dealers).

It should further be appreciated that the present disclosure contemplates that to enable remote EGMs to enable players to participate in live craps game plays at or based on a physical craps table, the craps gaming system 10 in various example embodiments provides the remote EGMs two types or categories of data in the data feed(s). Specifically, in various example embodiments, the craps gaming system provides the remote EGM: (i) real time or substantially real time video data feed of the physical craps table; and (ii) game state data. The video data feed or video feed of the physical craps table provided to the EGMs enables each of the EGMs to display the live actions or events at the physical craps table as they happen to the players at the EGMs. The game state data enables each of the EGMs to determine: (a) when to enable the player playing at that EGM to take certain actions such as making certain wagers; and (b) when and what payouts to pay the player playing at that EGM based on any of that player's wagers and the outcomes of the rolls of the physical dice at the physical craps table.

For example, the game state data can include any of the following data regarding the pair of dice: (a) data indicating the position of the physical dice on the playing surface of the physical craps table when the live players are making wagers; (b) data indicating movement of the physical dice on the playing surface of the physical craps table by the dealer (using the stick) and toward a shooter; (c) data indicating any rearrangement of the physical dice by the shooter on the playing surface of the physical craps table; (d) data indicating the shooter picking up the physical dice; (e) data indicating the period of time when the physical dice are held by the shooter before the roll of the physical dice by the player (and thus not on the playing surface of the physical craps table); (f) data indicating the roll of the physical dice onto the playing surface of the physical craps table; (g) data indicating the positions of the physical dice after both dice stop moving; (h) data indicating the positions of the dice if one or both of the physical dice are in an invalid position; (i) data indicating the numbers on the face up sides of the physical dice when the physical dice are in valid positions; and (j) data indicating the movement of the physical dice to a holding position while any wagers are paid out based on that roll of the dice and while any additional wagers are being made prior to the next roll of the physical dice.

The present disclosure further contemplates that the game state data can include but is not limited to any of the following data regarding each play of the craps game: (a) data indicating the start of a play of a craps game at the physical craps table; (b) data indicating that the craps game is in the "come-out" phase; (c) data indicating that no "point" has yet been selected for that play of the craps game; (d) data indicating whether the ON/OFF disc or button is in the ON position or the OFF position; (e) data indicating the position that the ON/OFF disc or button is at on the playing surface of the physical craps table (i.e., the point number that it is at); (f) data indicating the outcome or numbers on the dice for each roll of the dice; (g) data indicating that the craps game is in the "point" phase; (h) data indicating the point for that play of the craps game; (i) data indicating that a point has been rolled; and (j) data indicating that a seven has been rolled.

It should be appreciated that the specific game state data sent to an EGM will determine whether the EGM will enable a player to start participating in a play of a craps game at the physical craps table after that play of the craps game has begun.

Example Physical Craps Table Monitoring Systems, Craps Game State Data Processing System, and Dealer Station In various example embodiments of the craps gaming system of the present disclosure, the physical craps table monitoring system 50, the craps game state data processing system 60, and the dealer station 70 of the craps gaming system 10 work together to monitor the physical craps table 20 including the physical actions at a physical craps table 20, relay one or more feeds thereof, interpret certain of those physical actions, confirm certain of those interpreted physical actions, and provide the appropriate feeds and game state data to remote EGMs in real time or substantially real time to enable additional player participation in the physical craps game at the remote EGMs.

In various example embodiments of the craps gaming system of the present disclosure, the physical craps table monitoring system 50, the craps game state data processing system 60, and the dealer station 70 of the craps gaming system 10 also work individually or together to record or store of the determined game state data and associate such game state date directly with captured and stored video images.

In various embodiments of the present disclosure, as mentioned above, the craps game state data processing system 60 for the physical craps table is part of the dealer station 70 at the physical craps table as generally shown in FIG. 2A.

In various other embodiments of the present disclosure, the craps game state data processing system and dealer station are separate systems and are in communication with each other or configured to communicate with each other as generally shown in FIGS. 2B and 2C. In various such embodiments, the craps game state data processing system 60 can be configured to operate with multiple physical craps table monitoring systems 50 and multiple dealer stations 70 at or associated with multiple physical craps tables 20. In various such embodiments, the craps game state data processing system 60 can be configured to switch from providing one or more EGMs with: (i) first craps table video feeds and first craps game state data obtained based on craps game play at a first physical craps table, to (ii) other or second craps table video feed and other or second craps game state data obtained based on craps game play another or second physical craps table. In various embodiments of the present disclosure, this configuration enables the gaming system to find active physical craps tables and match them with active EGMs so that that players at active EGMs are always provided with the ability to participate in crap game plays at a physical craps table (even though one or more physical craps table of the craps gaming system are not active).

For ease of description, the configurations and operations of the craps game state data processing system and dealer station are separately described herein, although it should be appreciated that the configurations and operations can be combined in accordance with the present disclosure.

In various example embodiments of the present disclosure, the physical craps table monitoring system 50 and the craps game state data processing system 60 operate without any interaction or with very little interaction from any of the dealers at the physical craps table. In these example embodiments, the physical craps table monitoring system and the craps game state data processing system interpret all necessary physical actions at the physical craps table (including the sequential states of the play of each craps game and each material movement of the dice including roll outcomes) and provide the appropriate game state data to the remote EGMs in real time or substantially real time to enable additional player participation in the physical craps game (all without regular or without any inputs from any of the dealers at the physical craps table). In these example embodiments, no dealer station is needed at the physical craps table and the dealers at the physical craps table do not need to take additional actions at a dealer station. In these example embodiments, a dealer station could be provided for a rare instance in which dealer input is absolutely needed for the physical craps table.

Thus, it should be appreciated that in various example embodiments of the present disclosure, the physical craps table monitoring system and the craps game state data processing system can operate with limited interaction from one or more of the dealers at the physical craps table. In these example embodiments, the inputs from a dealer at the physical craps table are confirmatory inputs which are used to confirm the interpretation of one or more of the physical actions at the physical craps table captured by the physical craps table monitoring system and determined by the craps game state data processing system, or for other special circumstances.

Figure 4:
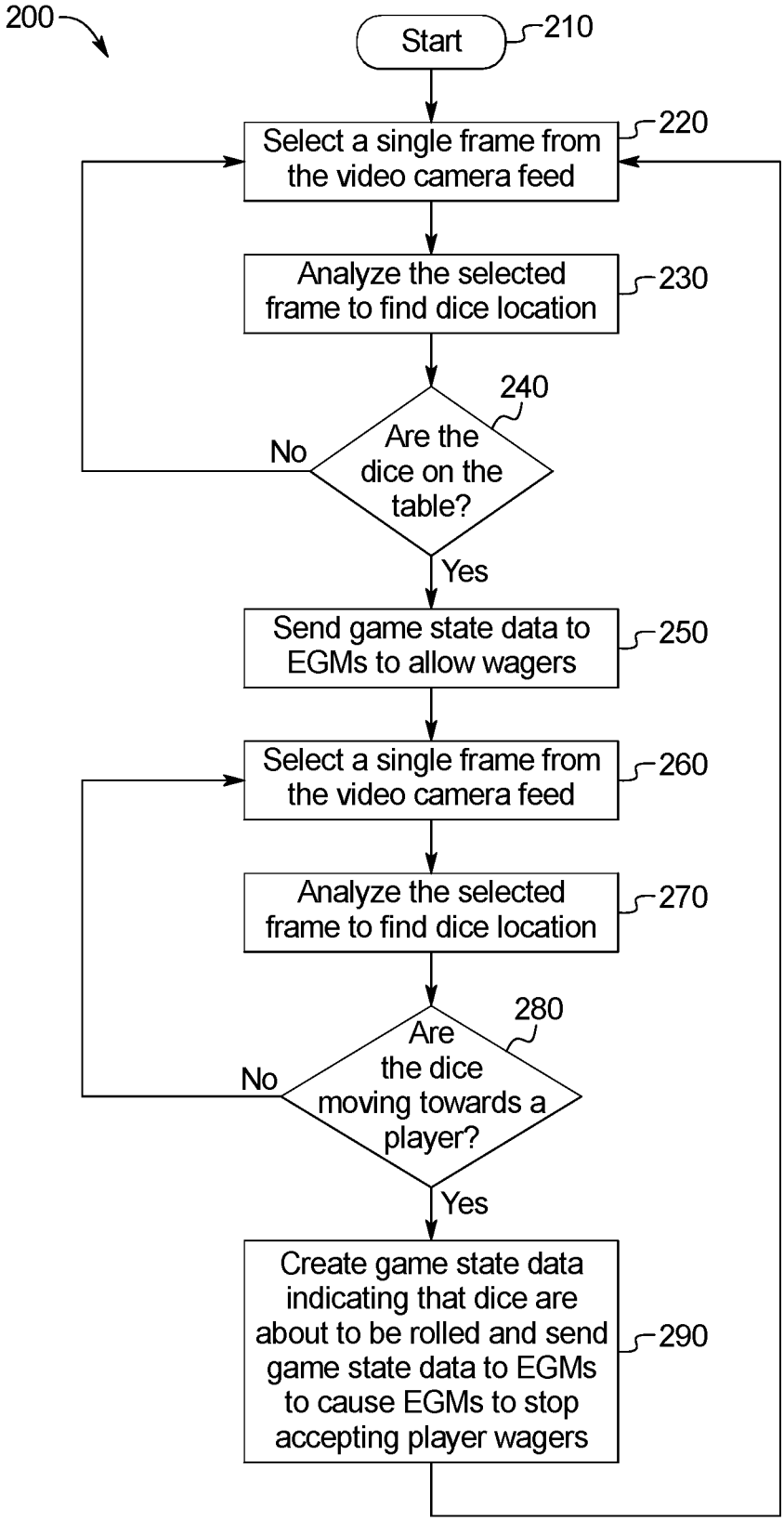
FIG. 4 is a flowchart illustrating certain parts of one example method of operation of the craps gaming systems of the present disclosure.
Figure 5:
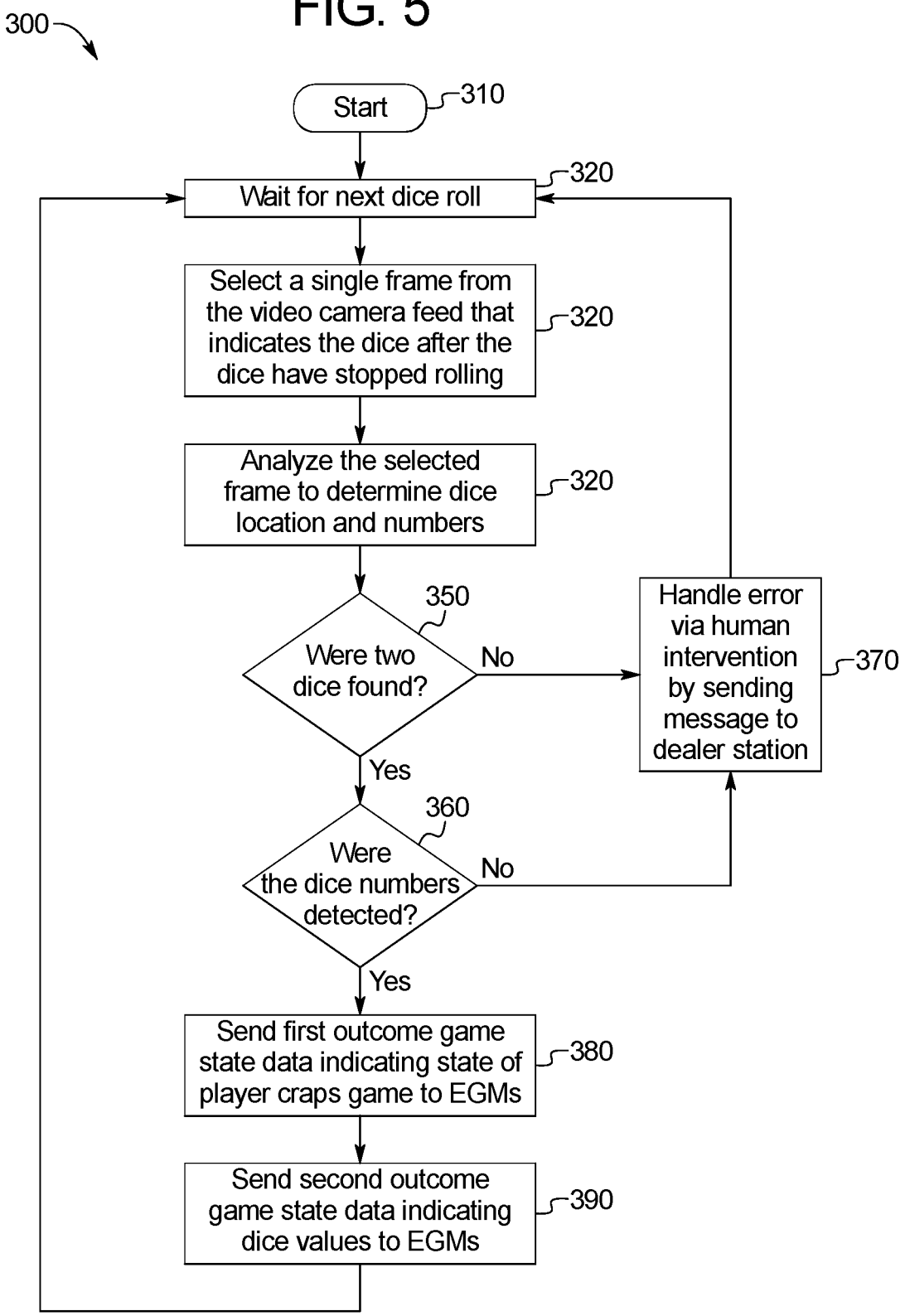
FIG. 5 is a flowchart illustrating certain parts of one example method of operation of the craps gaming systems of the present disclosure.

In various other example embodiments of the present disclosure as generally illustrated in FIGS. 4 and 5, the physical craps table monitoring system and the craps game state data processing system operate with regular interaction from one or more of the dealers at the physical craps table. It should be appreciated that the use of the term dealer in the present disclosure is meant to include anyone that may make inputs regarding events at the physical craps table and does not need to be one of the three people (described above) that typically act as dealers at a physical craps table. The present disclosure contemplates that the person who makes these inputs could be a person monitoring the physical craps table at a location near the physical craps table or at a location remote from the physical craps table. In certain such example embodiments, the person making such inputs can be watching the live video feed from the physical craps table and making inputs at a remote dealer station to confirm or create or assist in creating the game state data.

In certain of the example embodiments of FIGS. 1 to 7C, the inputs from a dealer using the dealer station at the physical craps table at least partly enable the physical craps table monitoring system and the craps game state data processing system to determine all of the necessary physical actions that occur at the physical craps table (including the states of the play of the craps game including the material dice movements including the dice roll outcomes) to create the game state data that is provided by the gaming system over a data network to the remote EGMs for the remote EGMs to in real time or substantially in real time enable additional player participation in the physical craps game.

As mentioned above, in various example embodiments of the present disclosure, the physical craps table monitoring system and the craps game state data processing system provide the continuous live video feed and the game state event data through a suitable electronic data network to the EGMs. This enables each EGM to display the continuous live video of the physical craps table to the player of the EGM. This also enables each EGM, in various embodiments, to provide graphical or simulated rolls of the dice and outcomes as corresponding to the game state data that is associated with rolls of the dice.

In various other example embodiments of the present disclosure, the physical craps table monitoring system and the craps game state data processing system provide only selected live video feed (such as selected video feed of the rolls of the dice) and game state event data over an electronic data network to the EGMs. This reduces the amounts of data transmission, while still enabling each EGM to display the selected video feed to the player of the EGM and to make determinations of any winning outcomes for the player at the EGM based on the received game state data and wagers made by the player at the EGM.

In certain embodiments of the present disclosure, the physical craps table monitoring system directly or indirectly communicates the live video feed of the physical craps table to the dealer station at the physical craps table to enable a dealer to see the video images of the physical craps table including the movements of physical dice being captured by the physical craps table monitoring system.

In various other example embodiments of the present disclosure, the physical craps table monitoring system and the craps game state data processing system provide game state event data over a data network to the EGMs (without any video feed) to enable each EGM to make determinations of any winning outcomes for the player at the EGM based on the game state data wagers made by the player at that EGM. In various such embodiments, the EGM may be configured to provide graphical or simulated rolls of the dice and outcomes corresponding to each game state data that is associated with the rolls of the dice and the outcomes.

Example Physical Craps Table Monitoring System

In the example embodiment of FIGS. 1 to 7C, the physical craps table monitoring system includes one or more table monitoring devices such as one or more analog or digital video cameras (shown in FIGS. 3A and 3B) positioned above the playing surface 24 of the physical craps table 20. These video cameras are configured to capture all of the actions, events, or material actions or events at the physical craps table (e.g., capture all of the physical material actions or events on or above the playing surface of the physical craps table including all or substantially all movements of and positions of the dice on or above the playing surface—including all rolls of the dice).

Figure 3A:
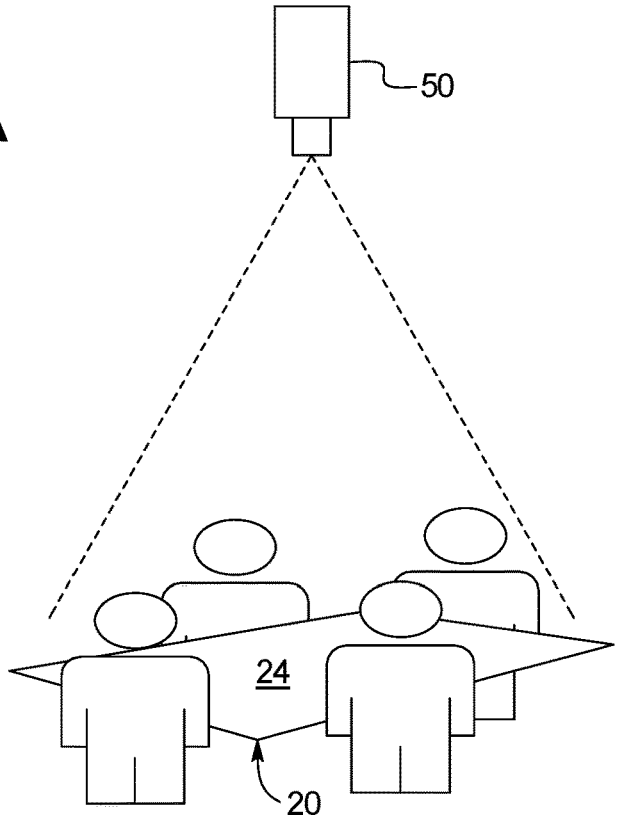
FIG. 3A is a diagrammatic view of a physical craps table and an example physical craps table monitoring system (including one video camera positioned above the physical craps table) of the craps gaming systems of the present disclosure.
Figure 3B:
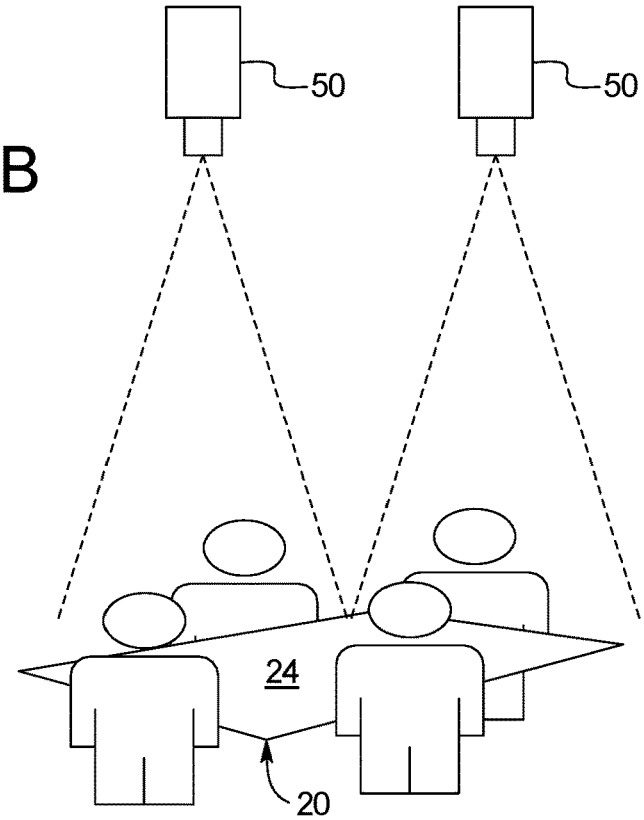
FIG. 3B is a diagrammatic view of a physical craps table and an example physical craps table monitoring system (including multiple video cameras positioned above the physical craps table) of the craps gaming systems of the present disclosure.

In various embodiments, the video cameras of the physical craps table monitoring system 50 are positioned above the physical craps table 20. In the illustrated example embodiment of FIGS. 3A and 3B, each of the video cameras is aimed downwardly at the physical craps table 20. It should be appreciated that multiple video cameras shown in FIG. 3B will likely better capture all of the physical movements at the physical craps table than a single video camera as shown in FIG. 3A. It should be appreciated that multiple cameras can also be used to diminish the effect of any of the players blocking parts of the playing surface of the physical craps table.

In various other embodiments, one or more of the video cameras (not shown) of the physical craps table monitoring system are alternatively or additionally positioned along the upright wall 26 of the physical craps table 20 such as below the upper ledge or rim 28 of the physical craps table 20. In these embodiments, each of the cameras is aimed at least partially downwardly at the playing surface 24 of physical craps table 20.

In various example embodiments of the present disclosure, the physical craps table monitoring system sends the captured live video feed of the physical craps table to the craps game state data processing system. This enables the craps game state data processing system to use that live video feed: (a) to relay that live video feed to the EGMs; and (b) to determine the necessary game state data from selected frames of the live video feed.

In various example embodiments of the present disclosure, the physical craps table monitoring system and the craps game state data processing system operate to determine all material or relevant physical actions related to the physical dice at the physical craps table to determine the game state data. In various such embodiments of the present disclosure, the physical craps table monitoring system functions as a physical dice position tracking system focused on capturing the positions of the dice at each and every significant point described above during a conventional play of a craps game at a physical craps table. These positions include but are not limited to: (a) a position of the physical dice when the live players are making wagers on the playing surface of the physical craps table; (b) the movement of the physical dice on the playing surface of the physical craps table by the dealer (using a stick) and toward a shooter; (c) any rearrangement of the physical dice by the shooter on the playing surface of the physical craps table; (d) the shooting picking up the physical dice; (e) the period of time when physical dice are held by the shooter before the roll of the physical dice by the player (and thus not on the playing surface of the physical craps table); (f) the roll of the physical dice onto the playing surface of the physical craps table; (g) the positions of the physical dice after both dice stop moving; (h) the positions of the dice if one or both of the physical dice are in an invalid position; (i) the numbers on the face up sides of the physical dice when the physical dice are in valid positions; and (j) the movement of the physical dice to a holding position while any wagers are paid out based on that roll of the dice and while any additional wagers are being made prior to the next roll of the physical dice.

In various other example embodiments of the present disclosure, the physical craps table monitoring system sends the captured live video feed of the physical to the craps game state data processing system. This enables the craps game state data processing system to use that live video feed to relay that live video feed to the EGMs in a coordinated manner with the necessary game state data However, in these alternative embodiments, the game state data is determined by the craps game state data processing system and/or by the dealer station directly based on specific inputs made by a dealer at the dealer station. In these example embodiments, the captured live video feed is not used to determine the game state data; rather, the inputs made by the dealer are used to determine the game state data.

In various example embodiments, the craps game state data processing system which generally includes one or more communication systems and one or more servers (including one or more processors and one or more memory devices that store a plurality of instructions executable by the processors to cause the processor to perform the various functions described herein) is generally configured to: (a) receive live video feed from the physical craps table monitoring system; (b) send the received live video feed to the dealer stations and to the EGMs; (c) analyze the live video feed received from the physical craps table monitoring system; (d) receive data from the dealer station(s); (e) send game state data to the dealer stations; and (f) send game state data to the EGMs. In various such example embodiments, the craps game state data processing system analyzes the live video feed received from the physical craps table monitoring system and receives inputs from the dealer station to determine specified game state data from the various possible game state data described such as to determine the locations and values of the rolled pair of dice.

In various other example embodiments, the craps game state data processing system is generally configured to: (a) receive live video feed from the dealer station which receives such video feed from the physical craps table monitoring system; (b) send the received live video feed to the EGMs; (c) analyze the live video feed received from the dealer station on a frame by frame or selected frame basis; (d) receive game state data from the dealer station; and (e) send game state data to the EGMs. It should be appreciated that the craps game state data processing system can analyze such frames using any suitable video or image processing systems that are currently known or developed in the future.

Thus, it should be appreciated that in various different embodiments of the gaming system, at each material point during each play of the craps game at the physical gaming table or for each change in state of the play of craps game at the physical gaming table, the dealer station and/or the craps game state data processing system determines the respective game state data and communicates that game state data to the EGMs.

FIGS. 4 and 5 generally illustrate certain parts of or steps of an example method or process indicated by numerals 200 and 300 that the craps game state data processing system performs relating to the detection of the dice and movements thereof for the determination of certain game state data to send to the EGMs. Generally, the craps game state data processing system employs this method to: (a) analyze the video feed to determine when a player at an EGM can and cannot make a wager; and (b) determine the numbers on the dice after a roll of the dice to enable the EGMs to handle the EGM player wagers.

This first part of the process as shown in FIG. 4 and indicated by numeral 200 starts as indicated by oval 210. The craps game state data processing system selects one or more frames (such as a single frame) from the video camera feed as indicated by block 220 to detect the location of the dice as indicated by block 220 and to determine if the dice are in a holding position on the playing surface such as a holding area of the playing surface of the physical craps table as indicated by block 230 and diamond 240. If the craps game state data processing system does not detect that the dice are in a holding position on the playing surface of the physical craps table, the craps game state data processing system returns to selecting another image as indicated in FIG. 4. If the craps game state data processing system detects that the dice are in a holding position on the playing surface such as a middle area of the playing surface of the physical craps table, the craps game state data processing knows that the dice are not yet going to be rolled due to the position of the dice and sends suitable game state data to the EGMs to enable or allow players at those EGMs to place wagers as indicated by block 250.

After a period of time which generally corresponds to the live players at the physical craps table making wagers, the dealer uses the stick to push the dice towards the player who will be the shooter when it is time for the shooter to roll the dice. The craps game state data processing system selects and analyzes one or more frames (such as a single frame) of the video feed to determine if the dice are being pushed towards a player as indicated in blocks 260 and 270 and by diamond 280. If the craps game state data processing system determines that the dice are not yet being pushed towards a player, the craps game state data processing system repeats the process indicated by blocks 260 and 270 and by diamond 280. If the craps game state data processing system determines that the dice are being pushed towards a player, the craps game state data processing system creates and sends game state data to the EGMs to indicate that the dice are about to be rolled or other suitable game state data to cause the EGMs to stop taking wagers from players at the EGMs as indicated by block 290. It should be appreciated that the craps game state data processing system may break this step up into several sub steps such as selecting and analyzing individual frames from the video feed to determine when the dice are close to the player and exactly when to send game state data to the EGMs to stop accepting bets.

Alternatively or additionally, when the shooter picks up the dice from the playing surface of the physical craps table, the craps game state data processing system analyzes one or more frames (such as a single frame) of the video feed to detect this event (i.e., that the dice numbers are no longer visible on the playing surface which indicates that the dice are in or under a the shooter's hand(s) to create game state data to send to the EGMs to indicate that the dice are about to be rolled or other suitable game state data to cause the EGMs to stop taking wagers from players at the EGMs).

This next part of the process starts, as indicated by oval 310 of FIG. 5, after the craps game state data processing system has previously detected that the dice are in a holding position on the playing surface such as a middle area of the playing surface of the physical craps table. At this point in the process, the craps game state data processing system is waiting for the dice roll and starts selecting frames for evaluation as indicated by block 320. At this point, the craps game state data processing system knows that the dice are going to be rolled.

After the shooter rolls the dice, the craps game state data processing system can analyze one or more selected frames (such as a single frame) of the video feed to detect that the dice are moving. The craps game state data processing system can, but would not necessary, create and send game state data to the EGMs to indicate that the dice are rolling.

After the dice stop rolling, generally the craps game state data processing system analyzes one or more frames (such as a single frame) of the video feed to determine the location of the dice and to determine the numbers on the stopped dice to create game state data to send to the EGMs to provide each EGM the numbers shown on the dice so that each EGM can determine any payouts that need to be made to the player of that EGM based on any wagers that the player made for that roll of the dice. More specifically, as indicated in FIG. 5, the craps game state data processing system selects one or more frames (such as a single frame) that indicates the dice after the dice have stopped rolling as indicted by block 330. The craps game state data processing system analyzes each of the selected frame(s) to determine the dice location and the dice numbers as indicated by block 340. For example, if a shooter at the physical craps table rolls a 6, the craps game state data processing system will send game state data of such die number to the EGMs.

If the craps game state data processing system cannot find the two dice or a selected frame with the two dice, or cannot determine the numbers on the dice as illustrated by diamonds 350 and 360, in this illustrated example embodiment, the craps game state data processing system will send a message to the dealer station to seek additional information from a dealer at the physical craps table as indicated by block 370. In such case where the roll is an invalid roll, the dealer will enter such a corresponding input that the roll is invalid into the dealer station. The craps game state data processing system will use such input or data from the dealer station to create and send game state data to the EGMs indicating that the roll was invalid, and then return to the point of waiting for a subsequent roll of the dice as indicated in FIG. 5. It should be appreciated that the gaming system and specifically the craps game state data processing system can account for invalid rolls in other different suitable manners in accordance with the present disclosure. Thus, the gaming system and specifically the craps game state data processing system accounts for dice position errors and edge conditions such as a die not landing flat on the playing surface, a die touching a players hand, or a die landing outside the craps table.

After the craps game state data processing system analyzes the selected frame and determines the dice location and the dice numbers, the craps game state data processing system in this illustrated example embodiment: (a) sends first outcome game state data indicating the state of the play of the craps game (such as point phase and point information) to the EGMs (if for this roll of the dice it has not already done so) as indicated by block 380; and (b) sends second outcome game state data indicating the numbers on the rolled dice to the EGMs as indicated by block 390. The craps game state data processing system will then return to the point of waiting for a subsequent roll of the dice as indicated in FIG. 5.

It should further be appreciated that in various different embodiments of the gaming system, the physical craps table monitoring system is used to capture and record security video of the physical craps table game. In various such embodiments, the craps gaming system of the present disclosure stores these video recordings with certain of the determined associated game state data. In various embodiments, the craps gaming system of the present disclosure enables these stored video recordings and related game state data to be searched by designated characteristics such as but not limited to: (a) players and their positions at the physical craps tables; (b) wagers made by player; (c) dice locations and physical movements of the dice; (d) outcomes of die rolls; (e) invalid rolls of the dice; and (f) manual entries by the dealer to change the dice values.

Rules, Minimums, Limits, and Paybacks

The present disclosure contemplates that the rules for the plays of the crap game at the EGMs can be the same or can be different than at the physical craps table. In the situations where they are different, the EGMs only need to receive certain game state data from the craps game state data processing system and use such received game state data to make determinations based on the rules being applied by the EGMs.

The present disclosure also contemplates that the player wagering requirements, minimums, and limits at the EGMs can be the same or can be different than at the physical craps table. For example, a physical craps table may have a relatively high minimum wager amount such as a $25, $50, or $100 minimum wager amount. Such physical craps tables would be typically considered to be catering toward higher rated players. The EGMs associated by the craps gaming system with such a physical craps table can have lower minimum wager amounts such as a $1 minimum wager amount. Thus, the craps gaming system of the present disclosure can enable players who do not or cannot wager such larger amounts to actively participate in a high minimum wager physical craps game.

The present disclosure further contemplates that one or more of the payouts or paybacks for the crap game at the EGMs can be the same or can be different than at the physical craps table.

Example Dealer Stations

The present disclosure contemplates various dealer stations and various displays at the dealer station, and various inputs enabled at the dealer stations. As mentioned above, the dealer station and the craps game state data processing system can in various embodiments be a combined or single unit. In the example embodiments described herein, the dealer station is described as a separate device from the craps game state data processing system for ease of description.

In various example embodiments, the dealer station includes a housing, one or more processors supported by the housing, one or more memory devices supported by the housing and configured to store a plurality of instructions executable by the processors, a display device supported by the housing, one or a plurality of input devices supported by the housing (including physical buttons and/or one or more touch screens), and suitable communication systems for enabling communication with other components of the craps gaming system such as the craps game state data processing system, the physical craps table monitoring system, and the EGMs.

The display device of the dealer station can be configured to display the live video feed of the physical craps table, events or indications of events that occur at the physical craps table, or requests or opportunities for inputs from the dealer regarding events that have occurred or that will occur at the physical craps table.

For example, the dealer station can generally be configured to display any of the following: (a) the live video feed of the physical game table; (b) the state of the play of the craps game; (c) the position of the dice determined by the craps game state data processing system; and (d) the dice numbers after a roll as determined by the craps game state data processing system.

The dealer station can also be configured to make requests to or enable inputs (by one or more buttons and/or the touch screen) from the dealer of any of the following: (a) indicate that player wagering is on, available, or allowed; (b) indicate that player wagering is off, not available, or not allowed; (c) an entry of or confirmation of the state of the craps game play; (d) an entry of or confirmation of the position of the dice determined by the craps game state data processing system; (f) a position of the dice; (g) a confirmation of the numbers shown on the dice after a roll of the dice as determined by the craps game state data processing system; and (h) an entry of the numbers shown on the dice after a roll of the dice.

It should thus be appreciated that in various example embodiments, the gaming system and specifically the dealer station enables a dealer to make one or more inputs that a roll of the dice is invalid. For example, when one or more of the dice is rolled and lands on edge, goes off the physical craps table, and/or is interfered with, the deader station enables the dealer to make an input declare that the roll was invalid. In various example embodiments, the craps game state data processing system is configured to receive data from the dealer station indicating that such roll was invalid and use that data to determine the appropriate game state data to send to the EGMs. In various example embodiments, such data overrides any determination made by the craps game state data processing system regarding the positions or numbers shown on the dice for that roll. Similarly, in various example embodiments, when the craps game state data processing system determines that that one or more die is missing from physical craps table, the craps game state data processing system can send a request to the dealer station to ask the dealer to confirm such determination. In various example embodiments, such data from the dealer station will override any determination made by the craps game state data processing system regarding the positions or numbers on the dice for that roll.

In various example embodiments, the gaming system and specifically the dealer station is configured to enable a dealer to make one or more inputs regarding an invalid roll of the dice that are considered security events. These security event inputs include, for example, a date, a time, a request that one or more still images or video captures of the event be stored. It should be appreciated that this stored data can be used in later forensics examination to detect player cheating or if a dealer was improperly entering game data such as game outcomes such as die numbers.

As mentioned above, the various dealer inputs and data resulting therefrom can assist: (a) in the operation of the craps game state data processing system; (b) in the craps game state data processing system determining the various game state data to send to the EGMs; (c) the craps game state data processing system in confirming determinations made by the craps game state data processing system; and/or (d) the craps game state data processing system in making determinations when craps game state data processing system is unable to otherwise make such determinations.

In various example embodiments, the dealer station can also enable a dealer to make one or more inputs to cause a notification to be sent to a player at one of the remote EGMs (or elsewhere) that a seat or position at the physical craps table is open or has opened up. For example, when a seat or position becomes available at the physical craps table, the dealer could input that information into the dealer station using the touch screen of the dealer station. The actual seat or position could be specified, the number of seats open could be specified, or simply that a seat is open could be specified. This information could be sent to one or more EGMs based on one or more characteristics or rules.

This feature gives players at the EGMs the opportunity to join the play at the physical craps table if desired. In various example embodiments, the EGMs can be configured to enable a player to make an input that they want to join the physical craps table if a seat or position becomes available at the physical craps table. In various example embodiments, the EGMs can be also configured to enable a player to make an input that they will join the physical craps table after being notified that a seat or position becomes available. In various example embodiments, the EGMs can be configured to send this notification back to the dealer station so that the dealer knows that the dealer should hold the open seat or position at the physical craps table for the player until the player arrives at the physical craps table.

In various example embodiments, the dealer station can notify players based on one or more factors such as but not limited to player status such as player loyalty club status or points or amounts played or wagered by the player. In these example embodiments, a player with a higher status would be notified before a player with lower status.

In various example embodiments, the dealer station could only notify certain player at EGMs based on the location of the EGMs. For example, a physical craps table could be connected to EGMs near the physical craps table and to EGMs located at a distant location such as another room, another casino, or over the internet. In such a situation, the dealer station can decide to only notify those players at EGMs that are located near the physical craps table.

In various example embodiments, the dealer station is configured to receive, maintain, and send various player seating or positioning data for the physical craps table. For example, in various example embodiments, an EGM is configured to: (a) enable the player at that EGM to make one or more inputs to request or reserve a seat or position at the physical craps table; and (b) send such request to the dealer station. In various example embodiments, the dealer station is configured to: (a) receive such requests or reservations for a seat or position at the physical craps table; (b) send an acknowledgement of such request back to the EGM; (c) place the player identification in a que for seating or positioning at the physical craps table; and (d) send a notification to the EGM when a seat or position at the physical craps table has opened based on the que.

In various example embodiments, the order of the que maintained by the dealer station can be determined by one or more characteristics such as but not limited to: (a) an order of the requests received; (b) the player status such as player loyalty club status of the players who made such requests; (c) the amounts of wagers made by the players; (d) the amounts won by the players; and (e) the amounts lost by the players. In various such embodiments, the dealer station displays a seating queue to the dealer at the physical craps table so that the dealer holds the seats or positions for the players at the appropriate times.

In various example embodiments, the gaming system of the present disclosure alternatively or additionally enables players to access a seat or position reservation mechanism or system from one or more other electronic devices besides the EGMs. For example, the gaming system can be configured to enable player to use their computer or electronic mobile device to access a web site or use a mobile application to reserve a seat or position at the physical craps table. In various such embodiments, the reservation can be associated with a player account, a player loyalty card or number, or a mobile application with the player information. In certain such embodiments, upon arriving at the physical craps table, the gaming system is configured to enable the player to use their player loyalty card or number, or their electronic mobile device to check in for the seat or position at the physical craps table.

EGM Displays

In various example embodiments of the present disclosure, the EGMs are configured to display any of the following: (a) a real time or substantially real time continuous video feed of the physical craps table; (b) a real time or substantially real time regular but not continuous video feed of the physical craps table; (c) video of selected events at the physical craps table; (d) graphical representations corresponding to events at the physical crap table; (e) indications of the craps game state (such as an indications that the craps game at the physical craps table is at the come out state, the point state, or the point); (f) outcomes of the dice rolls at the physical craps table; (g) wagers the player can make; (h) the wagers that the player has made and are pending; and (i) the awards based on the winning wagers that the player has made. It should be appreciated that the EGM can also display various other craps game related data, wagering game conventional information and/or data such as but not limited to the player's credit balance,

Players at the EGMs but No Players at the Physical Craps Table

In various embodiments, the craps gaming system of the present disclosure accounts for situations when there are no live players at the physical craps table but there are one or more players at the EGMs associated with that empty physical craps table.

It should be appreciated that this can occur due to many different reasons. For example, certain players will prefer to sit at the EGMs because: (a) they are more comfortable in a seated position; (b) they prefer the relative privacy of not having other people watching their wagering; (c) they prefer to wager on the action at the physical craps table but do not wish to take a turn rolling the dice; or (d) of one or more of a variety of other reasons.

In various example embodiments, when there are no live players at the physical craps table but there are one or more players at the EGMs associated with that physical craps table, the craps gaming system of the present disclosure disables or inactivates the respective EGMs associated with that physical craps table.

In various example embodiments, when there are no live players at the physical craps table but there are one or more players at the EGMs associated with that physical craps table, the craps gaming system of the present disclosure disassociates the respective EGMs from that physical craps table.

In various example embodiments, when there are no live players at the physical craps table but there are one or more players at the EGMs associated with that physical craps table, the craps gaming system of the present disclosure disassociates the respective EGMs from that physical craps table and re-associates the respective EGMs with another physical craps table with one or more live players.

In various example embodiments, when there are no live players at the physical craps table but there are one or more players at the EGMs associated with that physical craps table, the craps gaming system of the present disclosure disassociates the respective EGMs from that physical craps table and re-associates the respective EGMs with a random number generator that will generate numbers used to determine the dice rolls (which can be done for a group of EGMs or on an individual EGM basis)

In various example embodiments, when there are no live players at the physical craps table but there are one or more players at the EGMs associated with that physical craps table, the craps gaming system of the present disclosure disassociates the respective EGMs from that physical craps table and re-associates the respective EGMs with a random number generator that will generate numbers used to determine the dice rolls. The craps gaming system can do this for a group of EGMs or on an individual EGM basis. The craps gaming system can alternatively turn over control for such random number generation for plays of the craps game to the individual EGMs.

In various example embodiments, when there are no live players at the physical craps table but there are one or more players at the EGMs associated with that physical craps table, the craps gaming system of the present disclosure can receive random dice values chosen at the dealer station of the physical craps table.

In various example embodiments, when there are no live players at the physical craps table but there are one or more players at the EGMs associated with that physical craps table, the craps gaming system of the present disclosure can enable a dealer to roll the dice as a shooter at the physical craps table.

In various example embodiments, when there are no live players at the physical craps table but there are one or more players at the EGMs associated with that physical craps table, the craps gaming system of the present disclosure can enable a player at one of the EGMs to cause a suitable mechanical dice rolling mechanism to roll the dice as a shooter at the physical craps table (or alternatively in another location).

In various example embodiments, the dealer station is configured to enable a dealer to enter one or more inputs into the dealer station indicating that there are no live players at the physical craps table (in the situations when there are not players at the physical craps table). Likewise, in various embodiments, the dealer station is configured to enable a dealer to enter one or more inputs into the dealer station indicating that one or more live players have arrived or are seated or positioned at the physical craps table.

In various example embodiments, when there are no live players at the physical craps table but there are one or more players at the EGMs associated with that physical craps table, the craps gaming system of the present disclosure can replay previous live video feed of dice rolls (from that physical craps table or another physical craps table) and use associated game state data.

For example, when there are players at the physical craps table, the craps gaming system and specifically the craps game state data processing system can selectively record videos of dice roll outcomes and store such videos with related game state data. In this manner, the craps game state data processing system can store a library of dice roll videos from dice rolls resulting in values from 2 to 12. When no players are at the physical craps table, for each roll needed for players at the EGMs, the craps game state data processing system can randomly choose one of the saved dice rolls using a random number generator and send that randomly selected video along with related game state data to the EGMs to play the recorded video of the selected previous live dice roll and use the accompanying game state data to determine the outcomes for the players. Alternatively, when no players are at the physical craps table, for each roll needed for players at the EGMs, the craps game state data processing system can randomly choose a die roll outcome (such as one of the numbers 2 to 12) and then select an associated saved die roll video corresponding to that randomly selected number and send that selected video along with related game state data to the EGMs to play the recorded video of the selected previous live dice roll and use the accompanying game state data to determine the outcomes for the players. In various such embodiments, the EGMs will display an indication to the players when the video is live and when it is recorded in some manner as to not be misleading to the player.

It should be appreciated that while the player's credit balance, the player's wager, and any awards can be displayed by the EGMs as amounts of monetary credits or currency, in other embodiments, one or more of such player's credit balance, such player's wager, and any awards provided to such a player may be for non-monetary credits, promotional credits, and/or player tracking points or credits.

Players at Mobile EGMs

In various example embodiments, the craps gaming system of the present disclosure alternatively or additionally enables players to participate in the physical craps table as otherwise explained herein using electronic mobile devices as the EGMs. For example, the craps gaming system can be configured to enable players to use their computers or electronic mobile devices (such as their cell phones) to access a web site or use a mobile application to participate in plays of games at the physical craps table. In various such embodiments, the craps gaming system keep track of player accounts for such players. In various example embodiments, such play using such devices is for monetary credits or currency. In other various example embodiments, such play for such devices is for non-monetary credits, promotional credits, and/or player tracking points or credits. In such embodiments, the craps gaming system enables player to participate in real money or currency craps games at physical craps tables while not wagering real money or currency.

Advantages & Additional Alternative Embodiments

It should be appreciated from the above, that one advantage of the present disclosure is that the craps gaming system dramatically increases the quantity of players that can play a crap game. More specifically, a typical physical craps table can only accommodate approximately 10 to 12 players. The craps gaming system of various embodiments of the present disclosure can accommodate substantially more players such as hundreds of players in additional to the 10 to 12 players at the physical craps table. The craps gaming system also enables the remote players to be in the same casino as the physical craps table where the dice are being rolled or can be remote from that casino (i.e., they can be at another casino or virtually anywhere around the world).

Another advantage of the craps gaming system of the present disclosure is that it enables many players to remotely and simultaneously play a craps game with live players and with live dealers (which can include one or more live people functioning as the shooters).

Another advantage of the craps gaming system of the present disclosure is that it enables players are weary of random number generators or electronically randomly determined outcomes typically provided by electronic gaming machines such as slot machines to participate in a live craps game random outcomes determined by rolls of the dice, and thus feel that the craps game is fair because they can trust a physical outcomes of each roll of the dice.

Another advantage of the craps gaming system of the present disclosure is that it optimizes the use of the physical craps table and the live dealers at that table, and thus maximizes revenue.

Another advantage of the craps gaming system of the present disclosure is that it accounts for situations where no players are at or playing at the physical craps table while one or more players are playing at the remote EGMs.

Another advantage of the craps gaming system of the present disclosure is that it enables players to participate in a live craps game at a physical craps table while betting lower amounts than are typically required to be bet at a physical craps table (or non-credit values such as for causal game play).

Another advantage of the craps gaming system of the present disclosure is that it enables a player playing at a remote EGM associated with a physical craps table such as a player sitting at an EGM to reserve a next player seat or position or opening at the physical craps table.

Another advantage of the craps gaming system of the present disclosure is that it enables a player playing at a remote EGM associated with a physical craps table such as a player sitting at an EGM to be notified when a position is open at that physical craps table so the player can move from the EGM to the physical craps table for subsequent play of the physical craps game.

Another advantage of the craps gaming system of the present disclosure is that in various embodiments it automatically monitors the rolls of the dice, detects the various betting states at a physical craps table, and eliminates the need for the live dealer(s) at that physical craps table to have to manage or provide inputs or substantial for the craps gaming system while trying to simultaneously manage the physical craps table. In such embodiments, that the dealers simply deal craps and do not need pay any or much attention to or have much interaction with the gaming system of the present disclosure.

Another advantage of the craps gaming system of the present disclosure is that it provides a method of managing player positioning or seating at one or more physical craps table.

Another advantage of the gaming system of the present disclosure is that it provides the ability to monitor the physical craps tables with cameras for security events and historical game recalls.

Another advantage of the gaming system of the present disclosure is that it improves security because the game state data processing system is configured to evaluate and record or store of the game state data determine by it and associate such game state date directly with captured and stored video images.

Another advantage of the gaming system of the present disclosure is that it enables a physical craps table to be located in a different facility from the EGM. This enables a casino that is relatively small and doesn't have the revenue to support staffing of a physical craps table at that casino to provide access through the EGMs to such physical craps tables.

Another advantage of the gaming system of the present disclosure is that it enables future add on game features at the EGMs.

In various alternative embodiments of the present disclosure, the craps gaming system includes one or more physical dice rolling or throwing machines that are configured to roll or throw a pair of dice when a player is unavailable to roll the dice (such as when no player is at the physical craps table or when no player at the physical craps table wants to roll the dice).

In various other alternative embodiments of the present disclosure, the gaming system includes one or more physical dice rolling machines that are configured to roll the dice at or associated with the physical craps table that is not available to players.

In various embodiments of the present disclosure, the EGMs can add features to one or more plays of the craps game. In various embodiments, such features that may be activated in association with the play of the craps game include, but are not limited to:

i. a modifier, such as a multiplier, feature;
ii. a feature modifying an amount of credits of a credit balance;
iii. a feature modifying an amount of promotional credits;
iv. a feature modifying a placed wager amount;
v. a feature modifying a placed side wager amount;
vi. a feature modifying a rate of earning player tracking points;
vii. a feature modifying a paytable utilized for a play of a game;
viii. a feature modifying an average expected payback percentage of a play of a game;
ix. a feature modifying an average expected payout of a play of a game;
x. a feature modifying one or more awards available;
xi. a feature modifying a range of awards available;
xii. a feature modifying a type of awards available;
xiii. a feature modifying one or more progressive awards;
xiv. a feature modifying which progressive awards are available to be won;
xv. a feature modifying one or more modifiers, such as multipliers, available;
xvi. a feature modifying a generated outcome (or a designated generated outcome);
xvii. a feature modifying a generated outcome (or a designated generated outcome) associated with an award over a designated value;
xviii. a feature modifying a triggering event of a play of a secondary or bonus game;
xix. a feature modifying an activation of a secondary or bonus display (such as an award generator);
xx. a feature modifying a quantity of activations of a secondary or bonus display (e.g., a feature modifying a quantity of spins of an award generator);
xxi. a feature modifying a quantity of sections of a secondary or bonus display (e.g., a feature modifying a quantity of sections of an award generator);
xxii. a feature modifying one or more awards of a secondary or bonus display;
xxiii. a feature modifying an activation of a community award generator;
xxiv. a feature modifying a quantity of activations of a community award generator;
xxv. a feature modifying a quantity of sections of a community award generator;
xxvi. a feature modifying one or more awards of a community award generator;
xxvii. a feature modifying a generated outcome (or a designated generated outcome) in a secondary game;
xxviii. a feature modifying a game terminating or ending condition;
and/or
xxix. a feature modifying any game play feature associated with any play of any game disclosed herein.

In various different example embodiments, one or more awards provided in association with the craps games disclosed herein include one or more of: a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage for one or more plays of one or more games, one or more comps, such as a free dinner, a free night's stay at a hotel, a high value product such as a free car, or a low value product, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the craps gaming system, virtual goods not associated with the gaming system, an access code usable to unlock content on an internet.

It should be appreciated that the steps shown in flowcharts of the example processes or methods of operating the craps gaming system of the present disclosure can be implemented in various embodiments, by the execution of sets of instructions stored in one or more memories and executed by one or more processors of the craps gaming system. Although the processes and methods are described with reference to the flowcharts, many other processes of performing the acts associated with this illustrated process may be employed. For example, the order of certain of the illustrated blocks or diamonds may be changed, certain of the illustrated blocks or diamonds may be optional, or certain of the illustrated blocks or diamonds may not be employed.

Gaming Systems

The above-described embodiments of the present disclosure may be implemented in accordance with or in conjunction with or as part of one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices.

Thus, in various embodiments, the gaming system of the present disclosure includes, among other components described above: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, the term "EGM" is used herein to refer to an electronic gaming machine (such as a slot machine, a video poker machine, a video lottery terminal (VLT), a video keno machine, or a video bingo machine located on a casino floor). Additionally, for brevity and clarity and unless specifically stated otherwise, "EGM" as used herein represents one EGM or a plurality of EGMs, "personal gaming device" as used herein represents one personal gaming device or a plurality of personal gaming devices, and "central server, central controller, or remote host" as used herein represents one central server, central controller, or remote host or a plurality of central servers, central controllers, or remote hosts.

As noted above, in various embodiments, the gaming system includes an EGM (or personal gaming device) in combination with a central server, central controller, or remote host. In such embodiments, the EGM (or personal gaming device) is configured to communicate with the central server, central controller, or remote host through a data network or remote communication link. In certain such embodiments, the EGM (or personal gaming device) is configured to communicate with another EGM (or personal gaming device) through the same data network or remote communication link or through a different data network or remote communication link. For example, the gaming system includes a plurality of EGMs that are each configured to communicate with a central server, central controller, or remote host through a data network.

In certain embodiments in which the gaming system includes an EGM (or personal gaming device) in combination with a central server, central controller, or remote host, the central server, central controller, or remote host is any suitable computing device (such as a server) that includes at least one processor and at least one memory device or data storage device. As further described herein, the EGM (or personal gaming device) includes at least one EGM (or personal gaming device) processor configured to transmit and receive data or signals representing events, messages, commands, or any other suitable information between the EGM (or personal gaming device) and the central server, central controller, or remote host. The at least one processor of that EGM (or personal gaming device) is configured to execute the events, messages, or commands represented by such data or signals in conjunction with the operation of the EGM (or personal gaming device). Moreover, the at least one processor of the central server, central controller, or remote host is configured to transmit and receive data or signals representing events, messages, commands, or any other suitable information between the central server, central controller, or remote host and the EGM (or personal gaming device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal gaming device). Further, one, more than one, or each of the functions of the at least one processor of the EGM (or personal gaming device) may be performed by the at least one processor of the central server, central controller, or remote host.

In certain such embodiments, computerized instructions for controlling any games (such as any primary or base games and/or any secondary or bonus games) displayed by the EGM (or personal gaming device) are executed by the central server, central controller, or remote host. In such "thin client" embodiments, the central server, central controller, or remote host remotely controls any games (or other suitable interfaces) displayed by the EGM (or personal gaming device), and the EGM (or personal gaming device) is utilized to display such games (or suitable interfaces) and to receive one or more inputs or commands. In other such embodiments, computerized instructions for controlling any games displayed by the EGM (or personal gaming device) are communicated from the central server, central controller, or remote host to the EGM (or personal gaming device) and are stored in at least one memory device of the EGM (or personal gaming device). In such "thick client" embodiments, the at least one processor of the EGM (or personal gaming device) executes the computerized instructions to control any games (or other suitable interfaces) displayed by the EGM (or personal gaming device).

In various embodiments in which the gaming system includes a plurality of EGMs (or personal gaming devices), one or more of the EGMs (or personal gaming devices) are thin client EGMs (or personal gaming devices) and one or more of the EGMs (or personal gaming devices) are thick client EGMs (or personal gaming devices). In other embodiments in which the gaming system includes one or more EGMs (or personal gaming devices), certain functions of one or more of the EGMs (or personal gaming devices) are implemented in a thin client environment, and certain other functions of one or more of the EGMs (or personal gaming devices) are implemented in a thick client environment. In one such embodiment in which the gaming system includes an EGM (or personal gaming device) and a central server, central controller, or remote host, computerized instructions for controlling any primary or base games displayed by the EGM (or personal gaming device) are communicated from the central server, central controller, or remote host to the EGM (or personal gaming device) in a thick client configuration, and computerized instructions for controlling any secondary or bonus games or other functions displayed by the EGM (or personal gaming device) are executed by the central server, central controller, or remote host in a thin client configuration.

In certain embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is a local area network (LAN) in which the EGMs (or personal gaming devices) are located substantially proximate to one another and/or the central server, central controller, or remote host. In one example, the EGMs (or personal gaming devices) and the central server, central controller, or remote host are located in a gaming establishment or a portion of a gaming establishment.

In other embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is a wide area network (WAN) in which one or more of the EGMs (or personal gaming devices) are not necessarily located substantially proximate to another one of the EGMs (or personal gaming devices) and/or the central server, central controller, or remote host. For example, one or more of the EGMs (or personal gaming devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal gaming devices) are located. In certain embodiments in which the data network is a WAN, the gaming system includes a central server, central controller, or remote host and an EGM (or personal gaming device) each located in a different gaming establishment in a same geographic area, such as a same city or a same state. Gaming systems in which the data network is a WAN are substantially identical to gaming systems in which the data network is a LAN, though the quantity of EGMs (or personal gaming devices) in such gaming systems may vary relative to one another.

In further embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a data network, the data network is an internet (such as the Internet) or an intranet. In certain such embodiments, an Internet browser of the EGM (or personal gaming device) is usable to access an Internet game page from any location where an Internet connection is available. In one such embodiment, after the EGM (or personal gaming device) accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM (or personal gaming device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal gaming device). Examples of implementations of Internet-based gaming are further described in U.S. Pat. No. 8,764,566, entitled "Internet Remote Game Server," and U.S. Pat. No. 8,147,334, entitled "Universal Game Server."

The central server, central controller, or remote host and the EGM (or personal gaming device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal gaming devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 6:
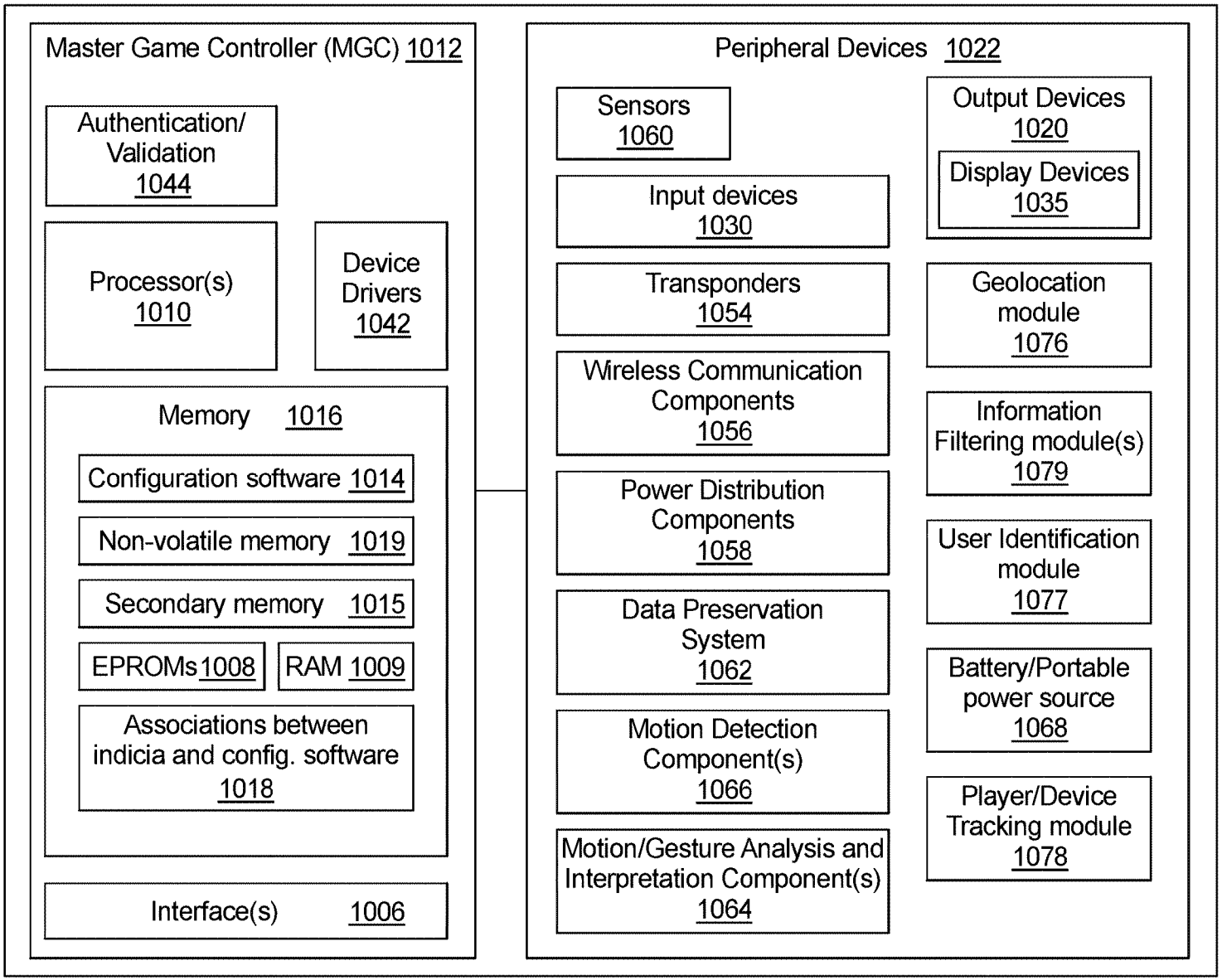
FIG. 6 is a schematic block diagram of one example embodiment of an electronic configuration of part of the craps gaming systems of the present disclosure.
Figure 7A:
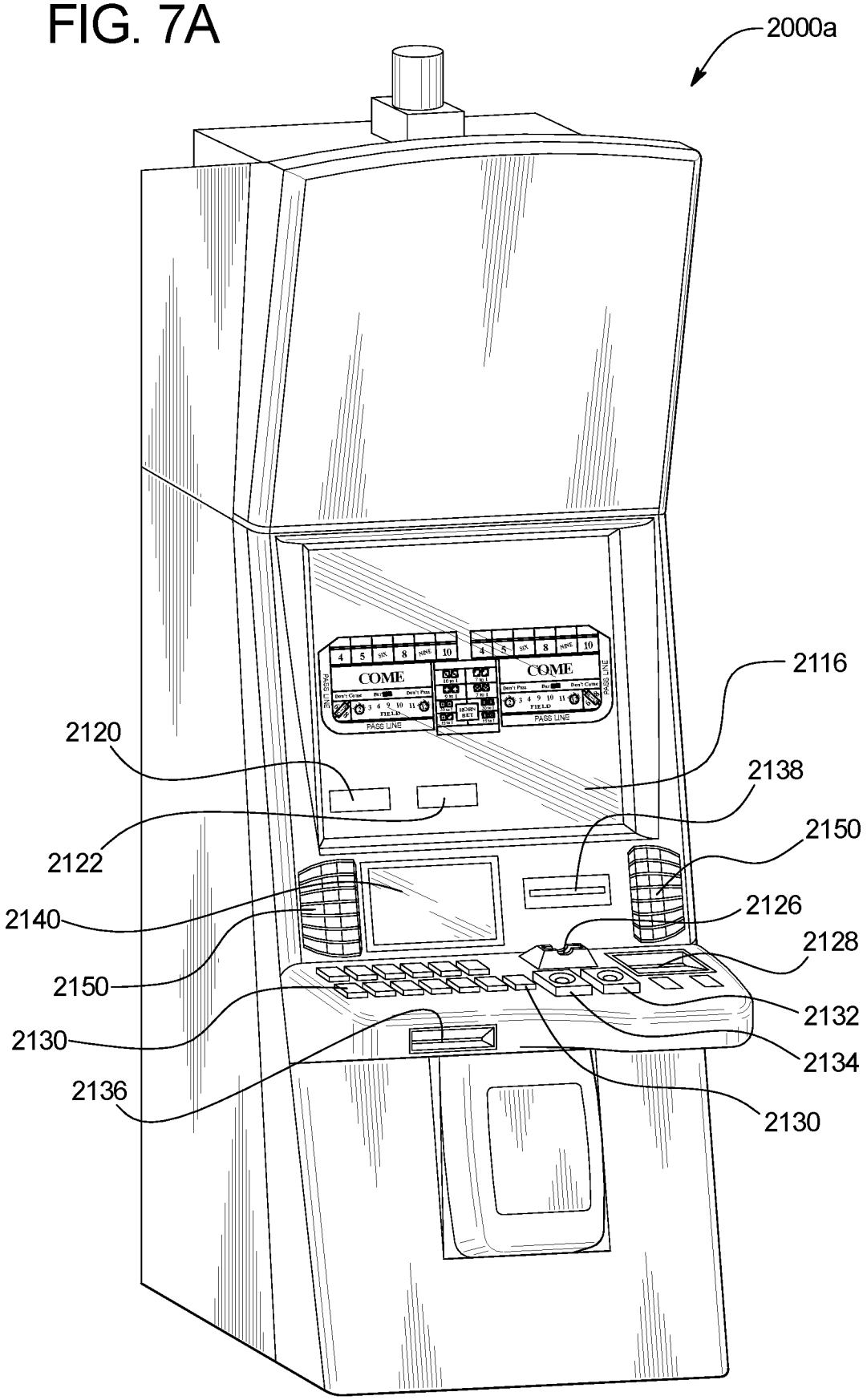
FIGS. 7A and 7B are perspective views of example alternative embodiments of EGMs of the craps gaming systems of the present disclosure.
Figure 7B:
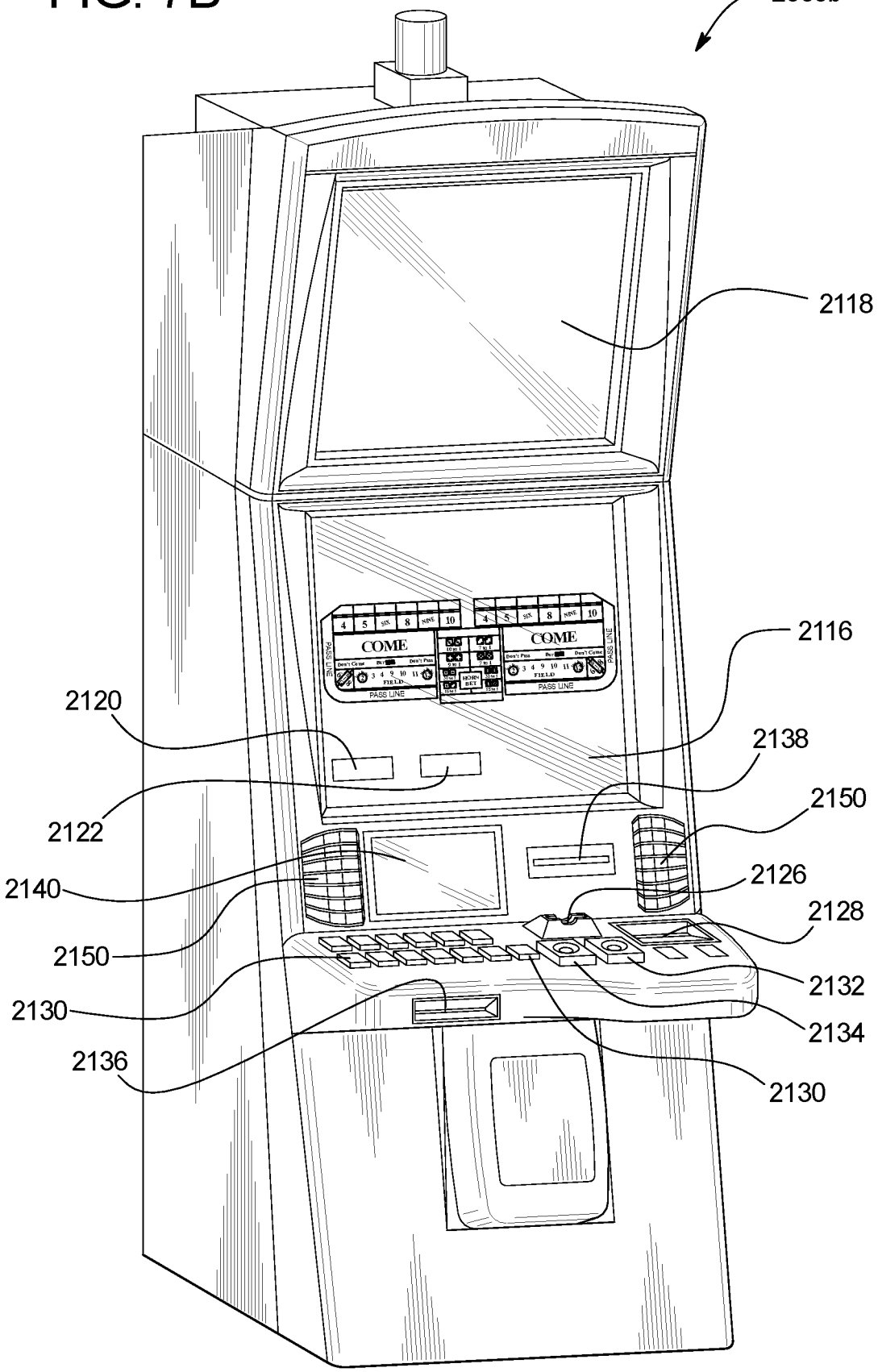
Figure 7C:
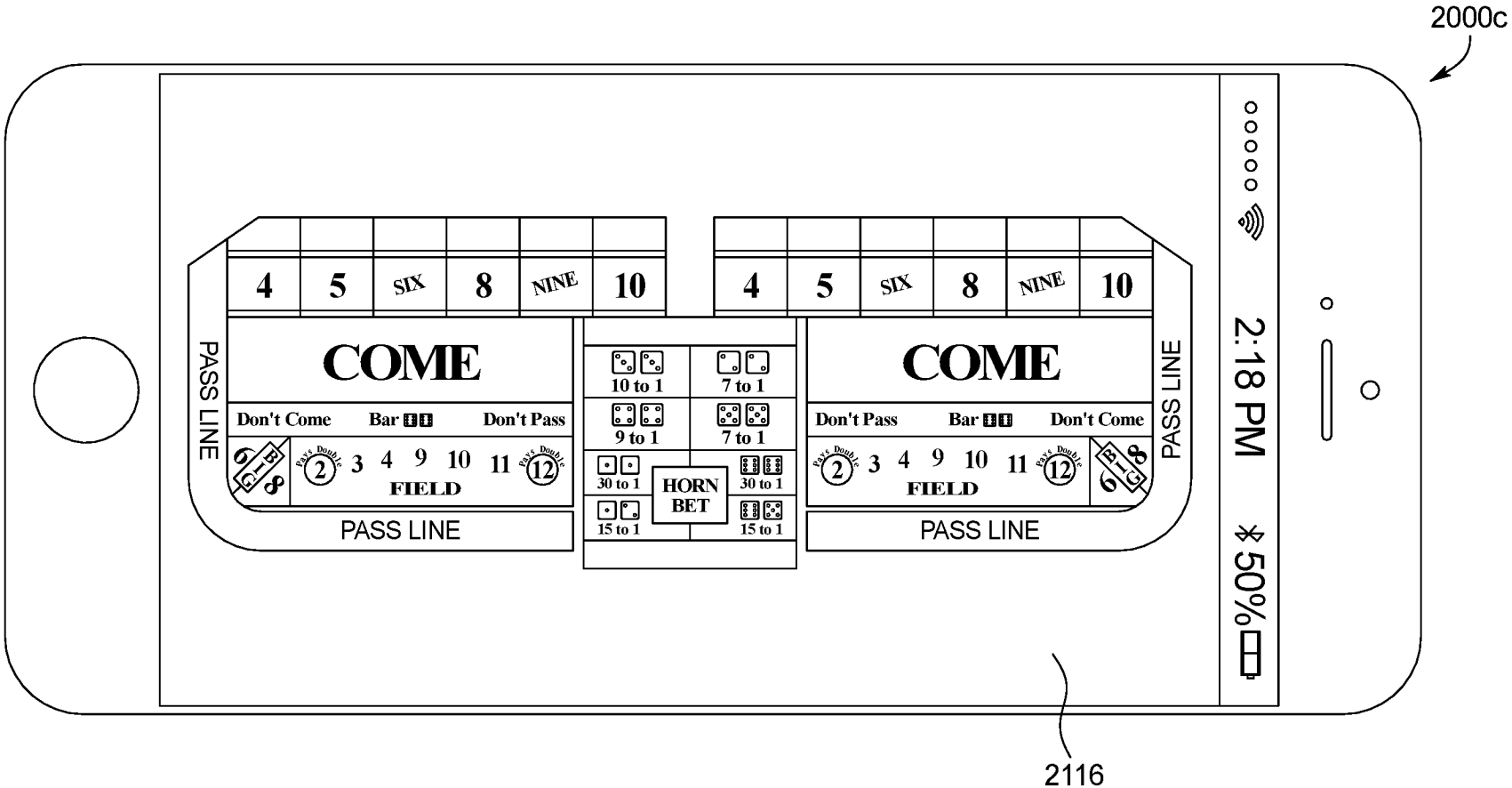
FIG. 7C is a front view of an example EGM in the form of an EGM in the form of electronic personal gaming device of the craps gaming systems of the present disclosure.

FIG. 6 is a block diagram of an example EGM 1000 and FIGS. 7A and 7B include two different example EGMs 2000*a* and 2000*b*. The EGMs 1000, 2000*a*, and 2000*b* are merely example EGMs, and different EGMs may be implemented using different combinations of the components shown in the EGMs 1000, 2000*a*, and 2000*b*. Although the below refers to EGMs, in various embodiments personal gaming devices (such as personal gaming device 2000*c* of FIG. 7C) may include some or all of the below components.

In these embodiments, the EGM 1000 includes a master gaming controller 1012 configured to communicate with and to operate with a plurality of peripheral devices 1022.

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets."

In certain embodiments, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 2000*a* illustrated in FIG. 7A includes a central display device 2116, a player tracking display 2140, a credit display 2120, and a bet display 2122. The example EGM 2000*b* illustrated in FIG. 7B includes a central display device 2116, an upper display device 2118, a player tracking display 2140, a credit display 2120, and a bet display 2122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGMs 2000*a* and 2000*b* illustrated in FIGS. 7A and 7B each include a ticket printer and dispenser 2136. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; U.S. Pat. No. 6,048,269, entitled "Coinless Slot Machine System and Method"; and U.S. Pat. No. 5,290,003, entitled "Gaming Machine and Coupons."

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine."

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGMs 2000*a* and 2000*b* illustrated in FIGS. 7A and 7B each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGMs 2000*a* and 2000*b* illustrated in FIGS. 7A and 7B each include a combined bill and ticket acceptor 2128 and a coin slot 2126.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine." When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGMs 2000*a* and 2000*b* illustrated in FIGS. 7A and 7B each include a game play activation device in the form of a game play initiation button 2132. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGMs 2000*a* and 2000*b* illustrated in FIGS. 7A and 7B each include a cashout device in the form of a cashout button 2134.

In various embodiments, the at least one input device 1030 includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGMs 2000*a* and 2000*b* illustrated in FIGS. 7A and 7B each include a plurality of such buttons 2130.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGMs 2000*a* and

2000*b* illustrated in FIGS. 7A and 7B each include a card reader 2138. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

The at least one motion/gesture analysis and interpretation component 1064 is configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM to operate in a mobile environment. For example, in one embodiment, the EGM 300 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

As generally described above, in certain embodiments, such as the example EGMs 2000*a* and 2000*b* illustrated in FIGS. 7A and 7B, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 2000*a* and 2000*b* shown in FIGS. 7A and 7B, EGMs may have varying housing and display configurations.

In certain embodiments, the EGM is a device that has obtained approval from a regulatory gaming commission, and in other embodiments, the EGM is a device that has not obtained approval from a regulatory gaming commission.

The EGMs described above are merely three examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

Operation of Primary or Base Games and/or Secondary or Bonus Games

In various embodiments, an EGM may be implemented in one of a variety of different configurations. In various embodiments, the EGM may be implemented as one of: (a) a dedicated EGM in which computerized game programs executable by the EGM for controlling any primary or base games (referred to herein as "primary games") and/or any secondary or bonus games or other functions (referred to herein as "secondary games") displayed by the EGM are provided with the EGM before delivery to a gaming establishment or before being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game."

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern."

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services."

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: video craps games; electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations."

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. Examples of progressive gaming systems are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards."

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win."

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services."

Web-Based Gaming

In various embodiments, the gaming system includes one or more servers configured to communicate with a personal gaming device-such as a smartphone, a tablet computer, a desktop computer, or a laptop computer-to enable web-based game play using the personal gaming device. In various embodiments, the player must first access a gaming website via an Internet browser of the personal gaming device or execute an application (commonly called an "app") installed on the personal gaming device before the player can use the personal gaming device to participate in web-based game play. In certain embodiments, the one or more servers and the personal gaming device operate in a thin-client environment. In these embodiments, the personal gaming device receives inputs via one or more input devices (such as a touch screen and/or physical buttons), the personal gaming device sends the received inputs to the one or more servers, the one or more servers make various determinations based on the inputs and determine content to be displayed (such as a randomly determined game outcome and corresponding award), the one or more servers send the content to the personal gaming device, and the personal gaming device displays the content.

In certain such embodiments, the one or more servers must identify the player before enabling game play on the personal gaming device (or, in some embodiments, before enabling monetary wager-based game play on the personal gaming device). In these embodiments, the player must identify herself to the one or more servers, such as by inputting the player's unique username and password combination, providing an input to a biometric sensor (e.g., a fingerprint sensor, a retinal sensor, a voice sensor, or a facial-recognition sensor), or providing any other suitable information.

Once identified, the one or more servers enable the player to establish an account balance from which the player can draw credits usable to wager on plays of a game. In certain embodiments, the one or more servers enable the player to initiate an electronic funds transfer to transfer funds from a bank account to the player's account balance. In other embodiments, the one or more servers enable the player to make a payment using the player's credit card, debit card, or other suitable device to add money to the player's account balance. In other embodiments, the one or more servers enable the player to add money to the player's account balance via a peer-to-peer type application, such as PayPal or Venmo. The one or more servers also enable the player to cash out the player's account balance (or part of it) in any suitable manner, such as via an electronic funds transfer, by initiating creation of a paper check that is mailed to the player, or by initiating printing of a voucher at a kiosk in a gaming establishment.

In certain embodiments, the one or more servers include a payment server that handles establishing and cashing out players' account balances and a separate game server configured to determine the outcome and any associated award for a play of a game. In these embodiments, the game server is configured to communicate with the personal gaming device and the payment device, and the personal gaming device and the payment device are not configured to directly communicate with one another. In these embodiments, when the game server receives data representing a request to start a play of a game at a desired wager, the game server sends data representing the desired wager to the payment server. The payment server determines whether the player's account balance can cover the desired wager (i.e., includes a monetary balance at least equal to the desired wager).

If the payment server determines that the player's account balance cannot cover the desired wager, the payment server notifies the game server, which then instructs the personal gaming device to display a suitable notification to the player that the player's account balance is too low to place the desired wager. If the payment server determines that the player's account balance can cover the desired wager, the payment server deducts the desired wager from the account balance and notifies the game server. The game server then determines an outcome and any associated award for the play of the game. The game server notifies the payment server of any nonzero award, and the payment server increases the player's account balance by the nonzero award. The game server sends data representing the outcome and any award to the personal gaming device, which displays the outcome and any award.

In certain embodiments, the one or more servers enable web-based game play using a personal gaming device only if the personal gaming device satisfies one or more jurisdictional requirements. In one embodiment, the one or more servers enable web-based game play using the personal gaming device only if the personal gaming device is located within a designated geographic area (such as within certain state or county lines or within the boundaries of a gaming establishment). In this embodiment, the geolocation module of the personal gaming device determines the location of the personal gaming device and sends the location to the one or more servers, which determine whether the personal gaming device is located within the designated geographic area. In various embodiments, the one or more servers enable non-monetary wager-based game play if the personal gaming device is located outside of the designated geographic area.

In various embodiments, the gaming system includes an EGM configured to communicate with a personal gaming device-such as a smartphone, a tablet computer, a desktop computer, or a laptop computer-to enable tethered mobile game play using the personal gaming device. Generally, in these embodiments, the EGM establishes communication with the personal gaming device and enables the player to play games on the EGM remotely via the personal gaming device. In certain embodiments, the gaming system includes a geo-fence system that enables tethered game play within a particular geographic area but not outside of that geographic area. Examples of tethering an EGM to a personal gaming device and geo-fencing are described in U.S. Patent Appl. Pub. No. 2013/0267324, entitled "Remote Gaming Method Allowing Temporary Inactivation Without Terminating Playing Session Due to Game Inactivity."

Social Network Integration

In certain embodiments, the gaming system is configured to communicate with a social network server that hosts or partially hosts a social networking website via a data network (such as the Internet) to integrate a player's gaming experience with the player's social networking account. This enables the gaming system to send certain information to the social network server that the social network server can use to create content (such as text, an image, and/or a video) and post it to the player's wall, newsfeed, or similar area of the social networking website accessible by the player's connections (and in certain cases the public) such that the player's connections can view that information. This also enables the gaming system to receive certain information from the social network server, such as the player's likes or dislikes or the player's list of connections. In certain embodiments, the gaming system enables the player to link the player's player account to the player's social networking account(s). This enables the gaming system to, once it identifies the player and initiates a gaming session (such as via the player logging in to a website (or an application) on the player's personal gaming device or via the player inserting the player's player tracking card into an EGM), link that gaming session to the player's social networking account(s). In other embodiments, the gaming system enables the player to link the player's social networking account(s) to individual gaming sessions when desired by providing the required login information.

For instance, in one embodiment, if a player wins a particular award (e.g., a progressive award or a jackpot award) or an award that exceeds a certain threshold (e.g., an award exceeding $1,000), the gaming system sends information about the award to the social network server to enable the server to create associated content (such as a screenshot of the outcome and associated award) and to post that content to the player's wall (or other suitable area) of the social networking website for the player's connections to see (and to entice them to play). In another embodiment, if a player joins a multiplayer game and there is another seat available, the gaming system sends that information to the social network sever to enable the server to create associated content (such as text indicating a vacancy for that particular game) and to post that content to the player's wall (or other suitable area) of the social networking website for the player's connections to see (and to entice them to fill the vacancy). In another embodiment, if the player consents, the gaming system sends advertisement information or offer information to the social network server to enable the social network server to create associated content (such as text or an image reflecting an advertisement and/or an offer) and to post that content to the player's wall (or other suitable area) of the social networking website for the player's connections to see. In another embodiment, the gaming system enables the player to recommend a game to the player's connections by posting a recommendation to the player's wall (or other suitable area) of the social networking website.

Differentiating Certain Gaming Systems from General Purpose Computing Devices Certain of the gaming systems described herein, such as EGMs located in a casino or another gaming establishment, include certain components and/or are configured to operate in certain manners that differentiate these systems from general purpose computing devices, i.e., certain personal gaming devices such as desktop computers and laptop computers.

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are not state-based machines, and a majority of data is usually lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication-EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes."

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just before the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just before when the malfunction occurred. The restored state may include metering information and graphical information that was displayed on the EGM in the state before the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just before the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM before, during, and/or after the disputed game to demonstrate whether the player was correct or not in the player's assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play."

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification."

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment."

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System."

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A craps gaming system comprising:

a dealer station positionable adjacent to a physical craps table having a playing surface for plays of a crap game at the physical craps table, the dealer station configured to receive, for a play of the craps game at the physical craps table:

a dealer input corresponding to when a pair of dice are at a holding position on the playing surface of the physical craps table, a dealer input corresponding to players being no longer allowed to wager on the play of the craps game, a dealer input corresponding to numbers shown on the pair of dice after a roll of the pair of dice for the play of the craps game, a dealer input corresponding to the roll of the pair of dice for the play of the craps game being an invalid roll; and a dealer input corresponding to a security event indicating a request that one or more images of the security event be stored;

a craps game state data processing system configured to:

communicate with the dealer station, create certain various game state data for the play of the craps game corresponding to:

the dealer input, via the dealer station, corresponding to when the pair of dice are at the holding position on the playing surface of the physical craps table, the dealer input, via the dealer station, corresponding to players being no longer allowed to wager on the play of the craps game, the dealer input, via the dealer station, corresponding to the numbers on the pair of dice after the roll of the pair of dice for the play of the craps game, the dealer input, via the dealer station, corresponding to the roll of the pair of dice for the play of the craps game being an invalid roll, the dealer input, via the dealer station corresponding to the security event indicating the request that one or more images of the security event be stored; and send the various game state data to a plurality of remote electronic gaming machines to enable each of the remote electronic gaming machines to:

disable player wagering at the remote electronic gaming machine responsive to the game state data indicating players being no longer allowed to wager on the play of the craps game, and determine any payouts responsive to the game state data indicating the numbers on the pair of dice for the play of the craps game.

2. The craps gaming system of claim 1, further comprising a physical craps table monitoring system comprising a video camera configured to capture live video of movements of the pair of dice on the playing surface of the physical craps table, the live video configured to be displayed by the remote electronic gaming machines.

3. The craps gaming system of claim 1, wherein the dealer station is further configured to receive, for the play of the craps game at the physical craps table, one of:

a dealer input corresponding to players being allowed to wager on the play of the craps game;

a dealer input corresponding to an entry regarding a state of the play of the craps game;

a dealer input corresponding to a position of the pair of dice;

a dealer input corresponding to when the pair of dice are being moved on the playing surface of the physical craps table toward a player at the physical craps table;

a dealer input corresponding to when the pair of dice have been picked up by a player at the physical craps table;

a dealer input corresponding to when the pair of dice have been rolled by a player at the physical craps table;

a dealer input corresponding to a confirmation of a position of the pair of dice determined by the craps game state data processing system; and a dealer input corresponding to a notification to be sent to a player at one of the remote electronic gaming machines that a position at the physical craps table is open.

4. The craps gaming system of claim 1, wherein the craps game state data processing system is further configured to create certain various game state data for the play of the craps game corresponding to one of:

a dealer input, via the dealer station, corresponding to players being allowed to wager on the play of the craps game;

a dealer input, via the dealer station, corresponding to a state of the play of the craps game;

a dealer input, via the dealer station, corresponding to a position of the pair of dice;

a dealer input, via the dealer station, corresponding to when the pair of dice are being moved on the playing surface of the physical craps table toward a player at the physical craps table;

a dealer input, via the dealer station, corresponding to when the pair of dice have been picked up by a player at the physical craps table;

a dealer input, via the dealer station, corresponding to when the pair of dice have been rolled by a player at the physical craps table;

a dealer input, via the dealer station, corresponding to a confirmation of position of the pair of dice determined by the craps game state data processing system; and a dealer input, via the dealer station, corresponding to a notification to be sent to a player at one of the remote electronic gaming machines that a position at the physical craps table is open.

5. The craps gaming system of claim 1, further configured to disassociate the remote electronic gaming machines from the physical craps table and to re-associate the remote electronic gaming machines with a random number generator.

6. The craps gaming system of claim 1, further configured to disassociate the remote electronic gaming machines from the physical craps table and to re-associate the remote electronic gaming machines with a mechanical dice rolling machine.

7. The craps gaming system of claim 1, wherein one of the remote electronic gaming machines is a mobile device.

8. The craps gaming system of claim 7, wherein the mobile device is configured to enable non-monetary wagers on the play of the craps game at the physical craps table.

9. The craps gaming system of claim 1, wherein the craps game state data processing system is further configured to provide alternative game state data to the remote electronic gaming machines when no players are at the physical craps table.

10. The craps gaming system of claim 1, wherein the dealer station and the craps game state data processing system are combined.

11. The craps gaming system of claim 1, wherein the dealer station is further configured to cause a display device of the dealer station to display a live video feed of the physical craps table.

12. The craps gaming system of claim 1, wherein the dealer station is further configured to cause a display device of the dealer station to display one of: an indication of a state of the play of the craps game; an indication of a position of the pair of dice on the physical craps table; and numbers on the pair of dice after a roll of the pair of dice at the physical craps table.

13. The craps gaming system of claim 1, wherein the dealer station is further configured to cause a display device of the dealer station to display a request for input from the dealer regarding one of: player wagering being allowed; player wagering being not allowed; a state of the play of the craps game; a position of the pair of dice; and numbers shown on the pair of dice after the roll of the pair of dice at the physical craps game.

14. A craps gaming system comprising:

a dealer station positionable adjacent to a physical craps table having a playing surface for plays of a crap game at the physical craps table, the dealer station configured to receive, for a play of the craps game at the physical craps table:

a dealer input corresponding to a position of a pair of dice;

a dealer input corresponding to when the pair of dice are at a holding position on the playing surface of the physical craps table, a dealer input corresponding to players being no longer allowed to wager on the play of the craps game, a dealer input corresponding to numbers shown on the pair of dice after a roll of the pair of dice for the play of the craps game, a dealer input corresponding to the roll of the pair of dice for the play of the craps game being an invalid roll, and a dealer input corresponding to a security event indicating a request that one or more images of the security event be stored;

a craps game state data processing system configured to:

communicate with the dealer station, create certain various game state data for the play of the craps game corresponding to:

the dealer input, via the dealer station, corresponding to a position of the pair of dice, the dealer input, via the dealer station, corresponding to when the pair of dice are at the holding position on the playing surface of the physical craps table, the dealer input, via the dealer station, corresponding to players being no longer allowed to wager on the play of the craps game, the dealer input, via the dealer station, corresponding to the numbers on the pair of dice after the roll of the pair of dice for the play of the craps game, and the dealer input, via the dealer station, corresponding to the roll of the pair of dice for the play of the craps game being an invalid roll, and send the various game state data to a plurality of remote electronic gaming machines to enable each of the remote electronic gaming machines to:

disable player wagering at the remote electronic gaming machine responsive to the game state data indicating players being no longer allowed to wager on the play of the craps game, and determine any payouts responsive to the game state data indicating the numbers on the pair of dice for the play of the craps game;

a physical craps table monitoring system comprising a video camera configured to capture live video of movements of the pair of dice on the playing surface of the physical craps table, the live video configured to be displayed by the remote electronic gaming machines.

15. A method of operating a craps gaming system, said method comprising:

receiving inputs via a dealer station positioned adjacent to a physical craps table for a play of the craps game at the physical craps table, the inputs comprising:

a dealer input corresponding to when a pair of dice are at a holding position on a playing surface of the physical craps table, a dealer input corresponding to players being no longer allowed to wager on the play of the craps game, a dealer input corresponding to numbers shown on the pair of dice after a roll of the pair of dice for the play of the craps game, a dealer input corresponding to the roll of the pair of dice for the play of the craps game being an invalid roll; and a dealer input corresponding to a security event indicating a request that one or more images of the security event be stored;

causing a craps game state data processing system to communicate with the dealer station;

causing a craps game state data processing system to create certain various game state data for the play of the craps game corresponding to:

the dealer input, via the dealer station, corresponding to when the pair of dice are at the holding position on the playing surface of the physical craps table, the dealer input, via the dealer station, corresponding to players being no longer allowed to wager on the play of the craps game, the dealer input, via the dealer station, corresponding to the numbers on the pair of dice after the roll of the pair of dice for the play of the craps game, the dealer input, via the dealer station, corresponding to the roll of the pair of dice for the play of the craps game being an invalid roll and, the dealer input, via the dealer station, corresponding to the security event indicating the request that one or more images of the security event be stored;

causing a craps game state data processing system to send the various game state data to a plurality of remote electronic gaming machines to enable each of the remote electronic gaming machines to:

disable player wagering at the remote electronic gaming machine responsive to the game state data indicating players being no longer allowed to wager on the play of the craps game, and determine any payouts responsive to the game state data indicating the numbers on the pair of dice for the play of the craps game.

16. The method of claim 15, further comprising causing a physical craps table monitoring system to capture live video of movements of the pair of dice on the playing surface of the physical craps table and causing the live video to be displayed by the remote electronic gaming machines.

17. The method of claim 15, which further comprises receiving, via the dealer station, for the play of the craps game at the physical craps table, one of:

a dealer input corresponding to players being allowed to wager on the play of the craps game;

a dealer input corresponding to an entry regarding a state of the play of the craps game;

a dealer input corresponding to a position of the pair of dice;

a dealer input corresponding to when the pair of dice are being moved on the playing surface of the physical craps table toward a player at the physical craps table;

a dealer input corresponding to when the pair of dice have been picked up by a player at the physical craps table;

a dealer input corresponding to when the pair of dice have been rolled by a player at the physical craps table;

a dealer input corresponding to a confirmation of a position of the pair of dice determined by the craps game state data processing system; and a dealer input corresponding to a notification to be sent to a player at one of the remote electronic gaming machines that a position at the physical craps table is open.

18. The method of claim 15, which further comprises creating the various game state data for the play of the craps game corresponding to one of:

a dealer input, via the dealer station, corresponding to players being allowed to wager on the play of the craps game;

a dealer input, via the dealer station, corresponding to a state of the play of the craps game;

a dealer input, via the dealer station, corresponding to a position of the pair of dice;

a dealer input, via the dealer station, corresponding to when the pair of dice are being moved on the playing surface of the physical craps table toward a player at the physical craps table;

a dealer input, via the dealer station, corresponding to when the pair of dice have been picked up by a player at the physical craps table;

a dealer input, via the dealer station, corresponding to when the pair of dice have been rolled by a player at the physical craps table; and a dealer input, via the dealer station, corresponding to a confirmation of position of the pair of dice determined by the craps game state data processing system; and a dealer input, via the dealer station, corresponding to a notification to be sent to a player at one of the remote electronic gaming machines that a position at the physical craps table is open.

19. The method of claim 15, which is partially provided through a data network.

20. The method of claim 19, wherein the data network is the internet.

* * * * *